US011034166B2

(12) United States Patent
Kodama et al.

(10) Patent No.: US 11,034,166 B2
(45) Date of Patent: Jun. 15, 2021

(54) RECORDING APPARATUS AND RELAYING APPARATUS

(71) Applicant: SEIKO EPSON CORPORATION, Tokyo (JP)

(72) Inventors: Hidetoshi Kodama, Matsumoto (JP); Isao Momose, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/914,487

(22) Filed: Mar. 7, 2018

(65) Prior Publication Data

US 2018/0272756 A1 Sep. 27, 2018

(30) Foreign Application Priority Data

Mar. 27, 2017 (JP) ..... JP2017-060607

(51) Int. Cl.

| | |
|---|---|
| ***B65H 29/62*** | (2006.01) |
| ***B41J 11/00*** | (2006.01) |
| ***B41J 13/10*** | (2006.01) |
| ***B41J 3/60*** | (2006.01) |

(52) U.S. Cl.

CPC ..... *B41J 11/0045* (2013.01); *B41J 3/60* (2013.01); *B41J 11/0015* (2013.01); *B41J 13/106* (2013.01)

(58) Field of Classification Search

CPC ..... B41J 2/125; H04N 1/4078; B29C 64/112
See application file for complete search history.

(56) References Cited

U.S. PATENT DOCUMENTS

| | | | | |
|---|---|---|---|---|
| 5,448,348 | A * | 9/1995 | Azeta | G03G 15/231 271/291 |
| 8,240,660 | B2 | 8/2012 | Yamamoto | |
| 8,387,980 | B2 * | 3/2013 | Kang | B41J 13/009 271/225 |
| 8,960,673 | B2 | 2/2015 | Yoshida | |
| 2010/0079528 | A1 | 4/2010 | Yamamoto | |
| 2010/0220346 | A1 * | 9/2010 | Hakamada | H04N 1/00885 358/1.13 |

(Continued)

FOREIGN PATENT DOCUMENTS

| | | |
|---|---|---|
| JP | S57-085758 | 5/1982 |
| JP | 2001-247245 | 9/2001 |

(Continued)

*Primary Examiner* — Lam S Nguyen
(74) *Attorney, Agent, or Firm* — Workman Nydegger

(57) ABSTRACT

A recording apparatus includes: a housing body in which a recording portion that performs recording is housed; a curved reversal path along a curve of which the medium, after the recording, is turned over to be guided to a position above the recording portion; a medium receiving tray that is provided over the recording portion at a position of horizontally overlapping with the housing body and receives the medium ejected through the curved reversal path; a relaying portion that is provided over the medium receiving tray at a position of horizontally overlapping with the housing body and sends the medium coming along the curved reversal path to an area horizontally outside the housing body; and a course switcher that switches a course of the medium beyond the curved reversal path to either the medium receiving tray or the relaying portion.

13 Claims, 11 Drawing Sheets

(56) References Cited

U.S. PATENT DOCUMENTS

| | | | | |
|---|---|---|---|---|
| 2013/0002750 | A1* | 1/2013 | Takenouchi | B41J 29/38 347/16 |
| 2014/0151955 | A1 | 6/2014 | Yoshida | |
| 2014/0291924 | A1 | 10/2014 | Isohara | |
| 2016/0116881 | A1 | 4/2016 | Kodama et al. | |
| 2016/0318728 | A1* | 11/2016 | Kowase | B65H 29/60 |

FOREIGN PATENT DOCUMENTS

| | | | |
|---|---|---|---|
| JP | 2002-114427 | | 4/2002 |
| JP | 2010-076908 | | 4/2010 |
| JP | 2014-108842 | | 6/2014 |
| JP | 2014-194474 | A | 10/2014 |
| JP | 2016-084236 | A | 5/2016 |

* cited by examiner

RECORDING APPARATUS AND RELAYING APPARATUS

CROSS REFERENCES TO RELATED APPLICATIONS

The entire disclosure of Japanese Patent Application No. 2017-060607, filed Mar. 27, 2017 is expressly incorporated by reference herein.

BACKGROUND

1. Technical Field

The disclosure relates to a recording apparatus that performs recording on a medium. The disclosure further relates to a relaying apparatus that receives a medium ejected from a recording apparatus and relays the medium to a post-processing apparatus.

2. Related Art

For a recording apparatus such as a printer or a copier, a post-processing apparatus (called also as "finisher") is provided in some cases. A post-processing apparatus performs post processing such as sorting or stapling after ejection of recording paper, which is an example of a medium. In many cases, a post-processing apparatus is installed in close contact with a recording apparatus.

If the recording apparatus is configured to perform recording by ejecting ink onto recording paper, that is, if the recording apparatus is an ink-jet printer, and if the recording paper ejected from the recording apparatus is immediately fed into the post-processing apparatus, there is a risk of, for example, transfer of ink from a sheet to another sheet because the ink has not dried, a risk of sorting error caused by a paper curl, and the like.

The following structure is disclosed in JP-A-2014-194474. A medium transportation unit (relay unit) is provided between a printer and a finisher. Recording paper is fed into the finisher by way of the medium transportation unit.

However, if a medium transportation unit is provided between a printer and a finisher, the size of the entire printing system will increase. Because of increased area occupancy, especially, occupancy in the horizontal direction, a large installation space will be required.

SUMMARY

An advantage of some aspects of the disclosure is to realize a compact recording system as a whole by disclosing a recording apparatus in which a relaying portion for feeding recording paper into a post-processing apparatus is provided in a space-saving manner.

A recording apparatus according to a first aspect of the disclosure includes: a housing body in which a recording portion that performs recording on a medium is housed; a curved reversal path along a curve of which the medium, after the recording by the recording portion, is turned over to be guided to a position above the recording portion; a medium receiving tray that is provided over the recording portion at a position of horizontally overlapping with the housing body and receives the medium ejected through the curved reversal path; a relaying portion that is provided over the medium receiving tray at a position of horizontally overlapping with the housing body and sends the medium coming along the curved reversal path to an area horizontally outside the housing body; and a course switcher that switches a course of the medium beyond the curved reversal path from one to the other, and from the other to one, of the medium receiving tray and the relaying portion.

In this aspect, the relaying portion, which sends the medium coming along the curved reversal path to an area horizontally outside the housing body is provided over the medium receiving tray at a position of overlapping with the housing body. Therefore, it is possible to reduce the horizontal area occupancy of the relaying portion configured to send the medium toward, for example, a post-processing apparatus installed at the area outside the housing body, or it is possible to avoid the relaying portion alone from occupying any horizontal area. In other words, a recording system that is compact as a whole is realized by providing the relaying portion in a space-saving manner.

A second mode of the disclosure is characterized in that, in the first aspect, the relaying portion is located downstream of a medium ejection opening beyond the curved reversal path; and the course switcher is provided in the relaying portion and performs switching whether to cause the medium to move into the relaying portion or to cause the medium to move toward the medium receiving tray.

Since the relaying portion is located downstream of the medium ejection opening beyond the curved reversal path, the structure of this mode makes it possible to eject the medium from the medium ejection opening even if the relaying portion has been detached.

A third mode of the disclosure is characterized in that, in the first aspect, the course switcher is provided upstream of a medium ejection opening beyond the curved reversal path, and performs switching whether to cause the medium exiting from the curved reversal path to move into the relaying portion not via the medium ejection opening or to cause the medium exiting from the curved reversal path to move toward the medium receiving tray via the medium ejection opening.

Since the course switcher is provided upstream of a medium ejection opening beyond the curved reversal path, and performs switching whether to cause the medium exiting from the curved reversal path to move into the relaying portion not via the medium ejection opening or to cause the medium exiting from the curved reversal path to move toward the medium receiving tray via the medium ejection opening, the structure of this mode ensures that the medium transportation path in the relaying portion is relatively long.

A fourth mode of the disclosure is characterized in that, in the first aspect, the relaying portion includes the course switcher; a reception opening for receiving the medium coming along the curved reversal path; and a medium ejection opening via which the medium is ejected toward the medium receiving tray; and wherein the course switcher performs switching whether to cause the medium received via the reception opening to move toward the area outside the housing body or to cause the medium received via the reception opening to move toward the medium receiving tray via the medium ejection opening.

With the structure of this mode, it is possible to provide the course switcher while achieving ease of work by assembling the relaying portion including the course switcher.

A fifth mode of the disclosure is characterized in that the recording apparatus according to the second mode further includes: a contact portion that is provided upstream of the medium ejection opening and produces, in the medium, a curved portion that is curved in a medium width direction by contact with at least a part of the medium in the medium width direction, which is a direction intersecting with a medium transportation direction; and wherein the contact portion is switchable between a first state, which is a state of contact with the medium in a case where the course switcher causes the medium to move toward the medium receiving tray, and a second state, which is a state of non-contact with the medium in a case where the course switcher causes the medium to move into the relaying portion.

Since the contact portion is put into the first state in a case where the course switcher causes the medium to move toward the medium receiving tray, the structure of this mode makes it possible to prevent the curling of the medium ejected onto the medium receiving tray, especially in the direction of medium ejection. Since the contact portion is put into the second state in a case where the course switcher causes the medium to move into the relaying portion, no curved portion is produced in the medium. Therefore, entry at the reception opening, at which the medium is received into the relaying portion, is smooth.

A sixth mode of the disclosure is characterized in that the recording apparatus according to any of the first aspect and the second to fifth modes further includes: a fan that blows air toward the medium ejected from the medium ejection opening; wherein the fan directs the air toward the medium receiving tray when in a state in which the course of the medium has been switched toward the medium receiving tray by the course switcher, and directs the air into a medium movement direction when in a state in which the course of the medium has been switched toward the relaying portion by the course switcher.

Since the recording apparatus further includes the fan that blows air toward the medium ejected from the medium ejection opening, and since the fan directs the air toward the medium receiving tray when in a state in which the course of the medium has been switched toward the medium receiving tray by the course switcher, it is possible to let the medium fall onto the medium receiving tray properly. Moreover, since the fan directs the air into the direction of movement of the medium when in a state in which the course of the medium has been switched toward the relaying portion by the course switcher, it is possible to cause the medium to move into the reception opening, at which the medium is received into the relaying portion, properly.

A seventh mode of the disclosure is characterized in that, in any of the first aspect and the second to sixth modes, the relaying portion includes a first ejection opening for ejection of the received medium to the area outside the housing body; a second ejection opening for ejection of the received medium from a downstream side toward an upstream side of the medium receiving tray; and an ejection direction switcher that switches the course of the medium from one to the other, and from the other to one, of the first ejection opening and the second ejection opening.

Since the relaying portion includes the second ejection opening as another ejection opening for ejection of the received medium in addition to the first ejection opening, the structure of this mode increases the degree of freedom in medium ejection.

An eighth mode of the disclosure is characterized in that, in any of the first aspect and the second to sixth modes, the relaying portion includes a guide member that guides the medium ejected from the second ejection opening onto the medium receiving tray while turning over the medium.

Since the relaying portion includes a guide member that guides the medium ejected from the second ejection opening onto the medium receiving tray while turning over the medium, the structure of this mode makes it possible to switch which side of the medium is to be oriented toward the medium receiving tray (switching between "face up" and "face down), thereby meeting diverse needs of users.

A ninth mode of the disclosure is characterized in that, in any of the first aspect and the second to eighth modes, the relaying portion includes a plurality of ejection paths through which the received medium is able to be ejected to the area outside the housing body; and an ejection path switcher that performs switching for selecting one of the plurality of ejection paths for the received medium.

Since the relaying portion includes a plurality of ejection paths through which the received medium is able to be ejected to the area outside the housing body, and further includes an ejection path switcher that performs switching for selecting one of the plurality of ejection paths for the received medium, the structure of this mode makes it possible to accept a larger amount of the medium into the relaying portion, and, especially in a case where liquid is ejected by the recording portion onto the medium, it is possible to allow longer time for the liquid to dry inside the relaying portion.

A tenth mode of the disclosure is characterized in that, in any of the first aspect and the second to ninth modes, the relaying portion ejects the medium to a post-processing apparatus that is installed adjacent to the recording apparatus.

With this structure, in a case where a post-processing apparatus is installed adjacent to the recording apparatus, it is possible to reduce the horizontal area occupancy of the relaying portion, or it is possible to avoid the relaying portion alone from occupying any horizontal area, thereby realizing a recording system that is compact as a whole.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
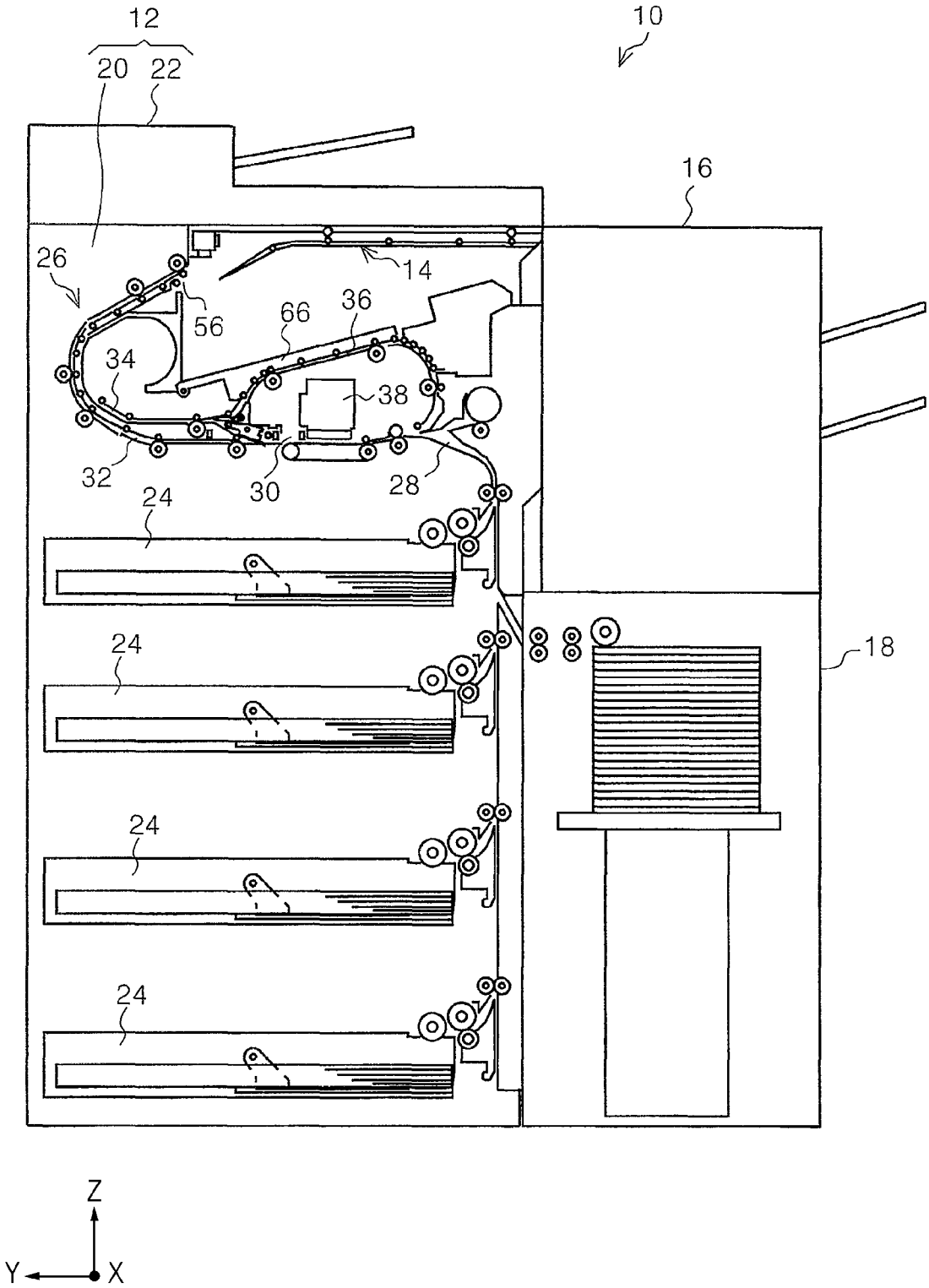
FIG. 1 is a front view of a recording system according to exemplary embodiments of the disclosure.

With reference to the accompanying drawings, exemplary embodiments of the present disclosure will now be explained. In each embodiment, the same reference numerals are assigned to the same components, and they are explained in the first embodiment only. An explanation of them is omitted in the second and subsequent embodiments.

Figure 2:
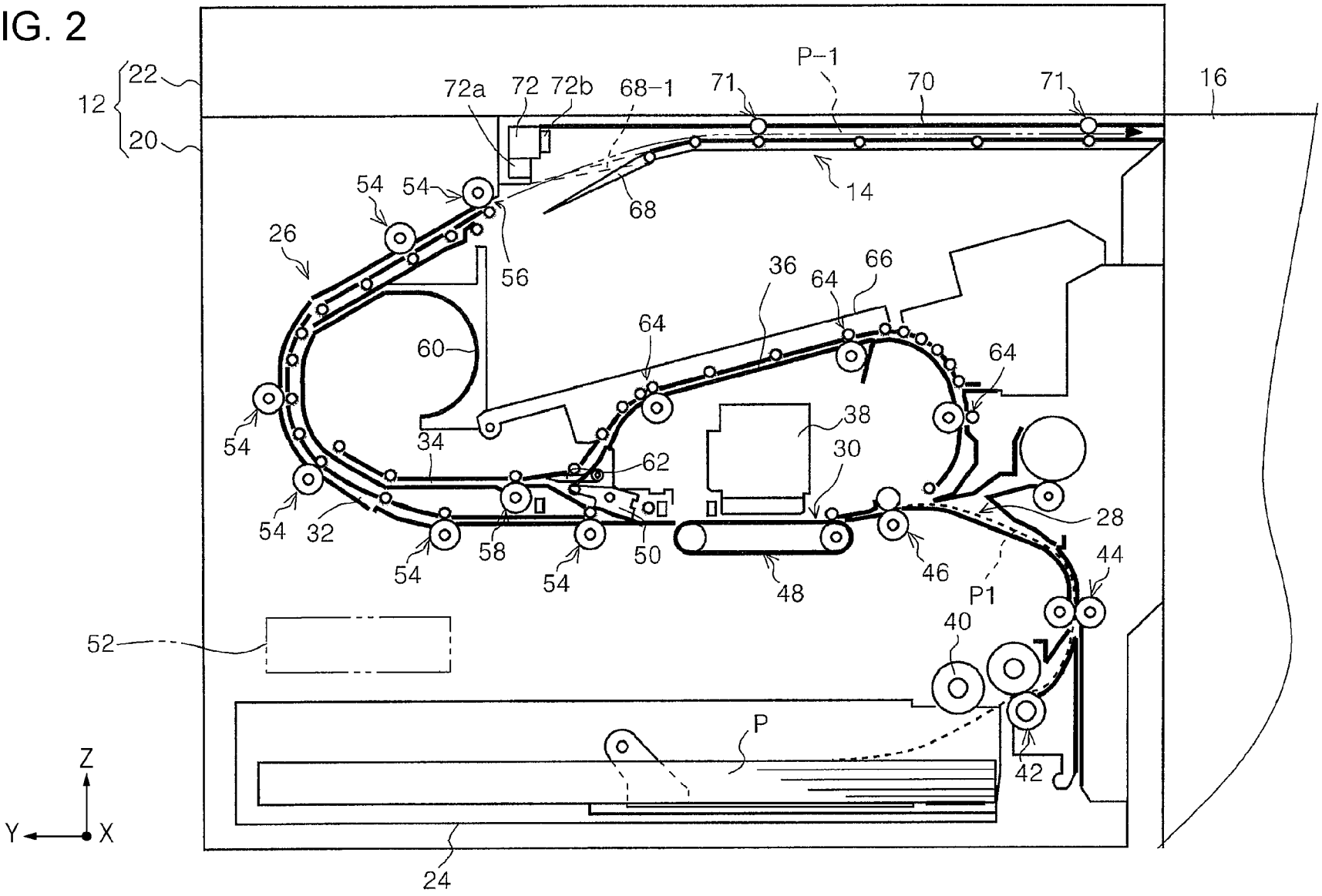
FIG. 2 is a side view of a transportation path in a printer that is provided with a relaying portion according to a first embodiment.
Figure 3:
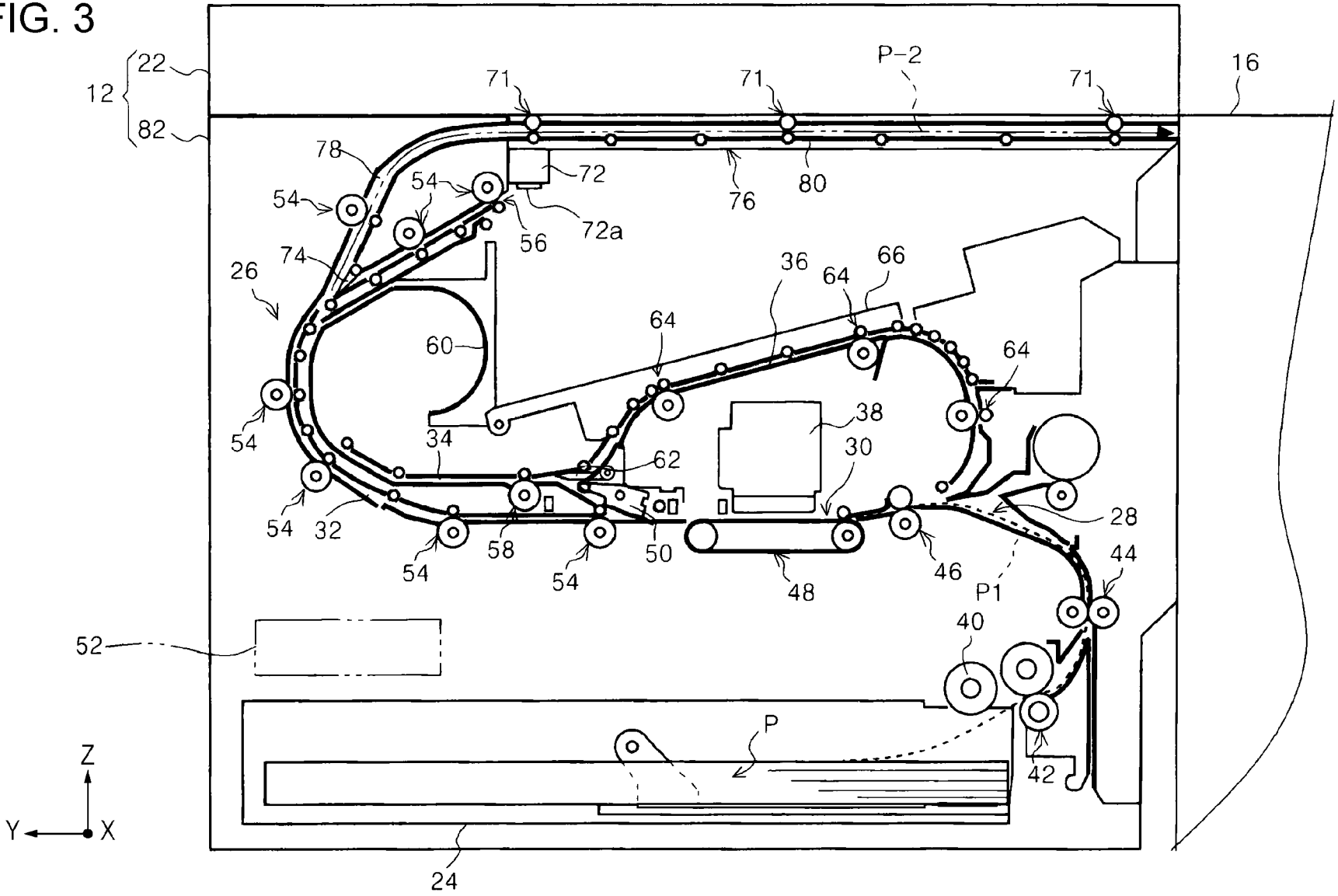
FIG. 3 is a side view of a transportation path in a printer that is provided with a relaying portion according to a second embodiment.
Figure 4:
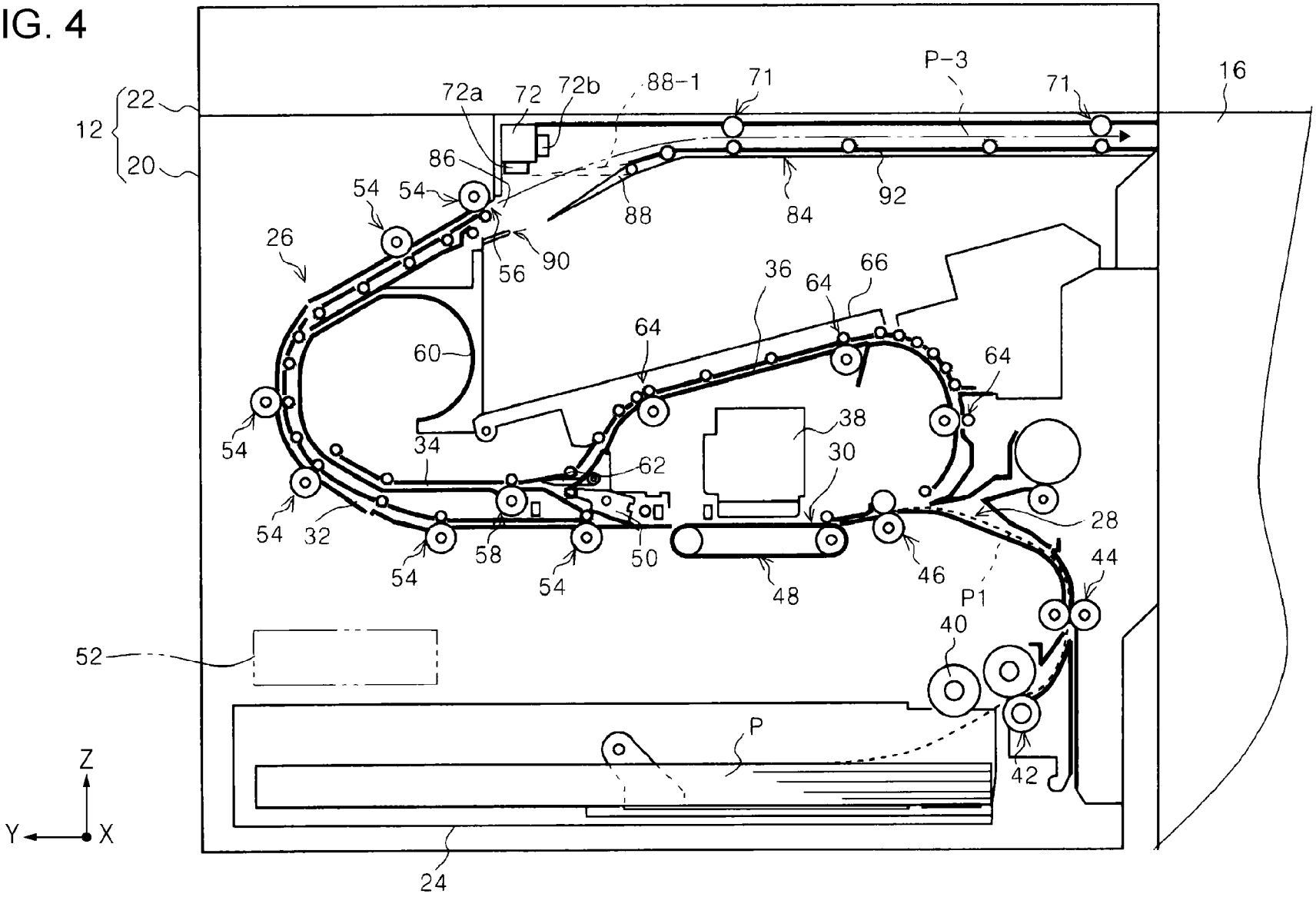
FIG. 4 is a side view of a transportation path in a printer that is provided with a relaying portion according to a third embodiment.

FIG. 1 is a front view of a recording system according to exemplary embodiments of the disclosure. FIG. 2 is a side view of a transportation path in a printer that is provided with a relaying portion according to a first embodiment. FIG. 3 is a side view of a transportation path in a printer that is provided with a relaying portion according to a second embodiment. FIG. 4 is a side view of a transportation path in a printer that is provided with a relaying portion according to a third embodiment.

Figure 5:
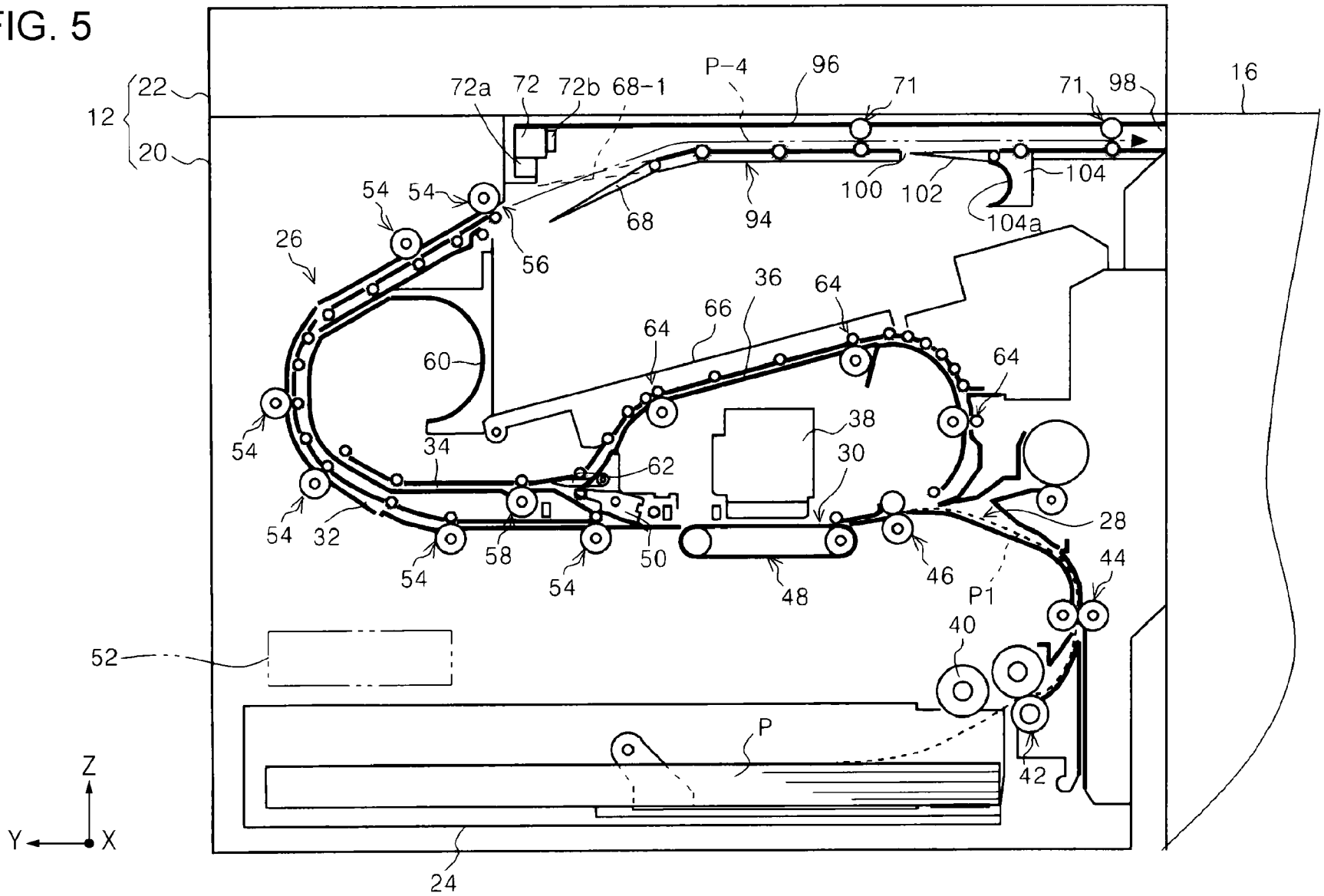
FIG. 5 is a side view of, in a transportation path in a printer that is provided with a relaying portion according to a fourth embodiment, a path of a medium sent toward an ejection processing unit.
Figure 6:
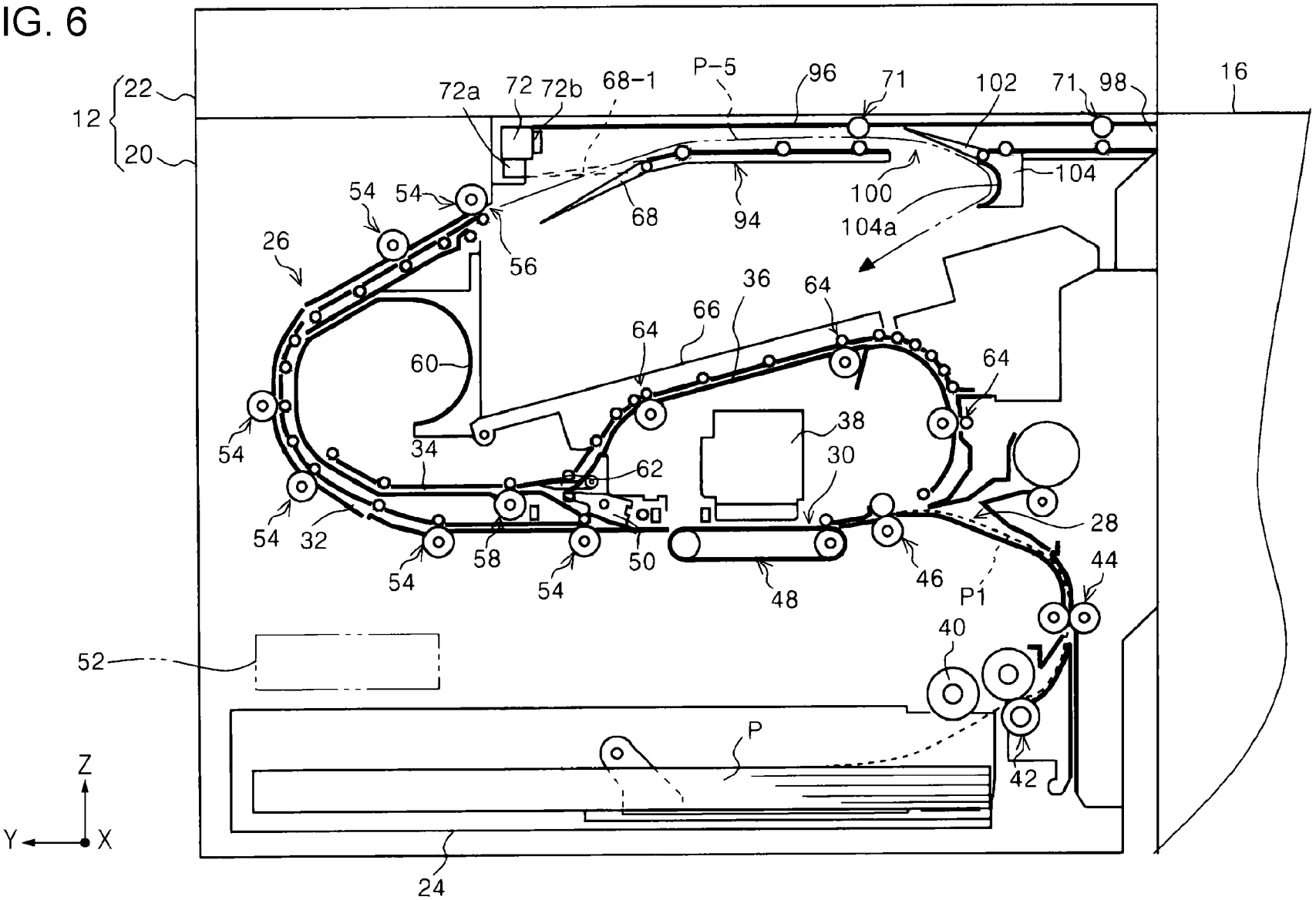
FIG. 6 is a side view of, in a transportation path in a printer that is provided with a relaying portion according to a fourth embodiment, a path of a medium sent toward a medium receiving tray.

FIG. 5 is a side view of, in a transportation path in a printer that is provided with a relaying portion according to a fourth embodiment, a path of a medium sent toward an ejection processing unit. FIG. 6 is a side view of, in a transportation path in a printer that is provided with a relaying portion according to a fourth embodiment, a path of a medium sent toward a medium receiving tray.

Figure 7:
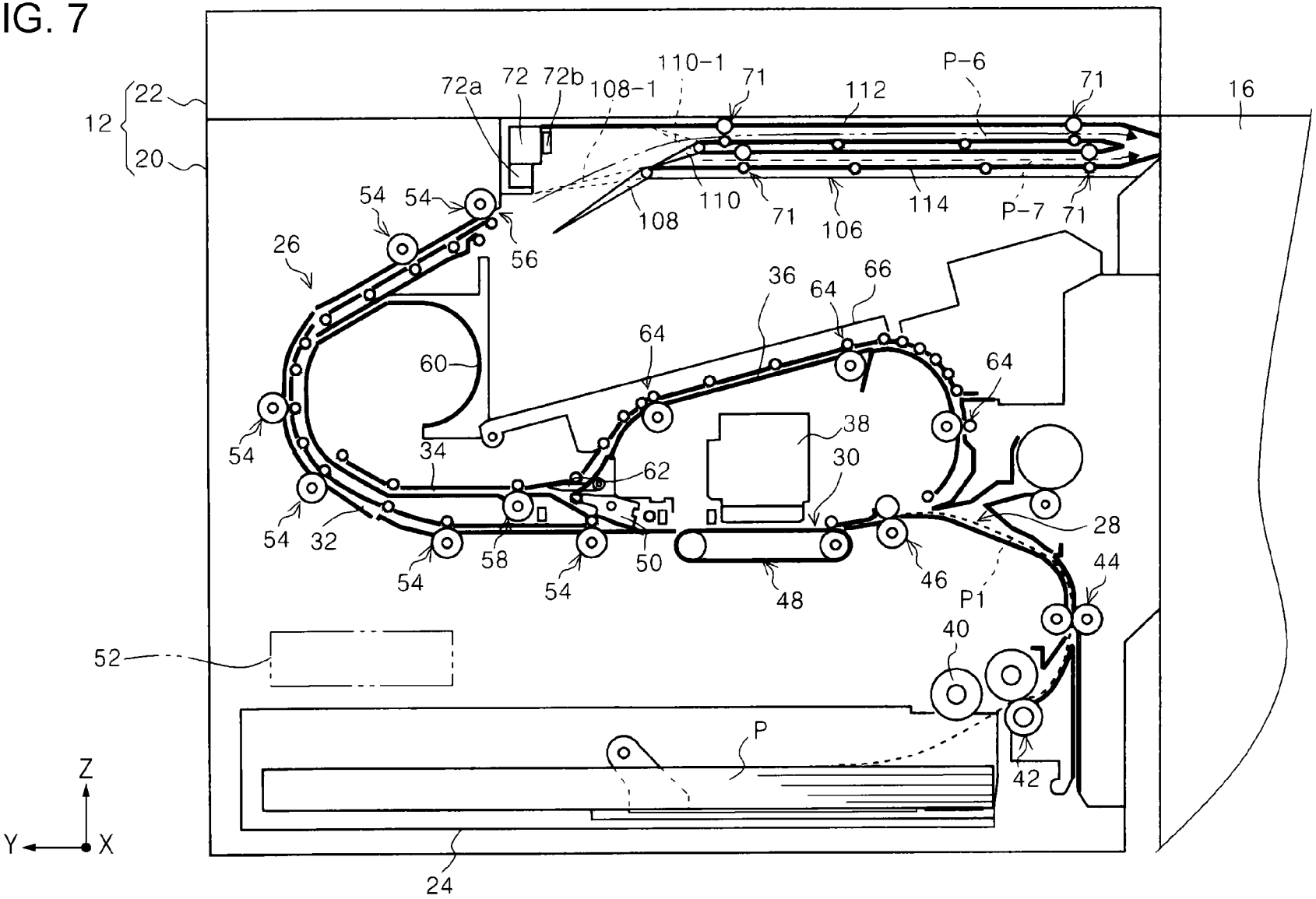
FIG. 7 is a side view of a transportation path in a printer that is provided with a relaying portion according to a fifth embodiment.
Figure 8:
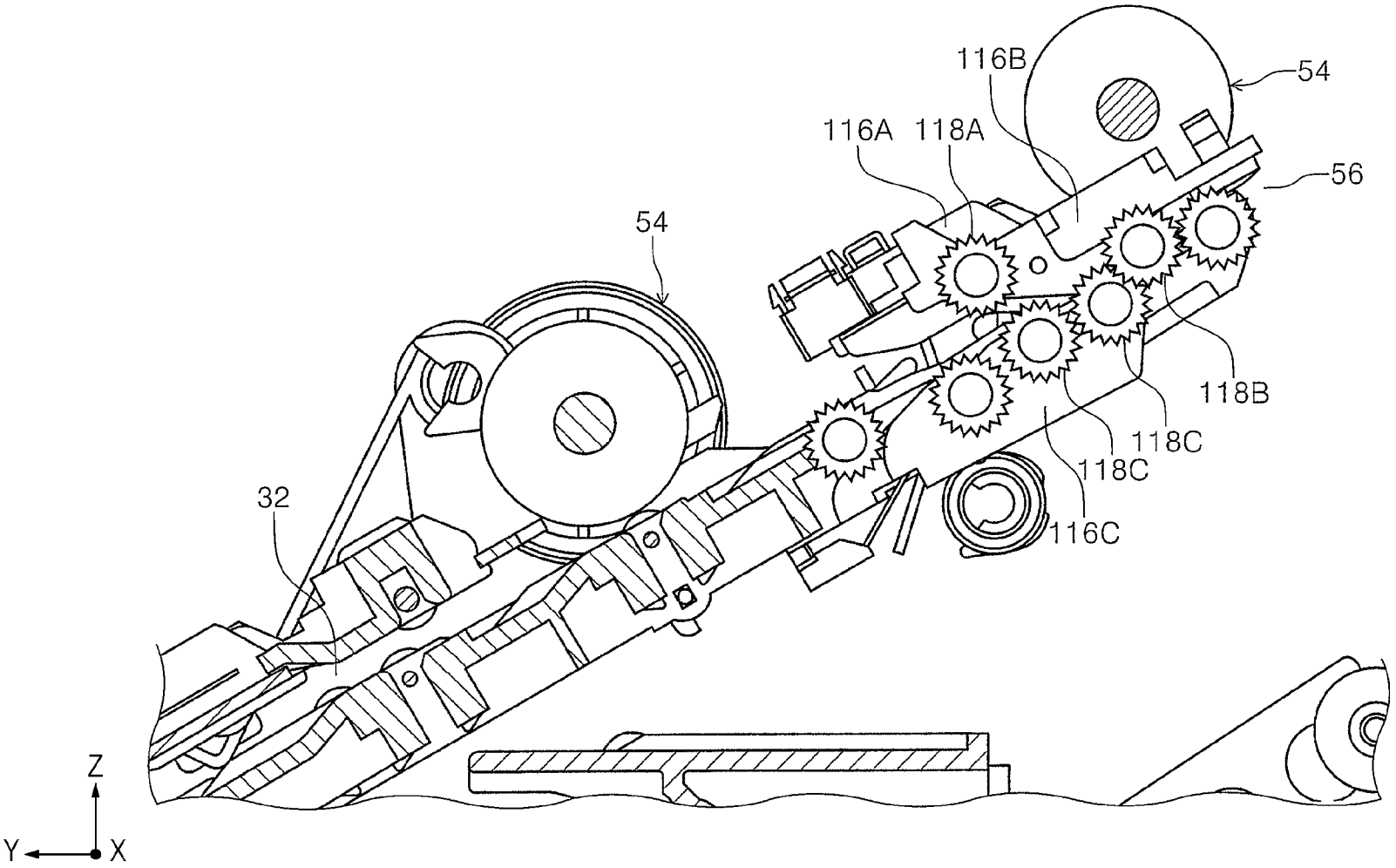
FIG. 8 is a side cross-sectional view of the neighborhood of an ejection opening of a printer according to exemplary embodiments of the disclosure.
Figure 9:
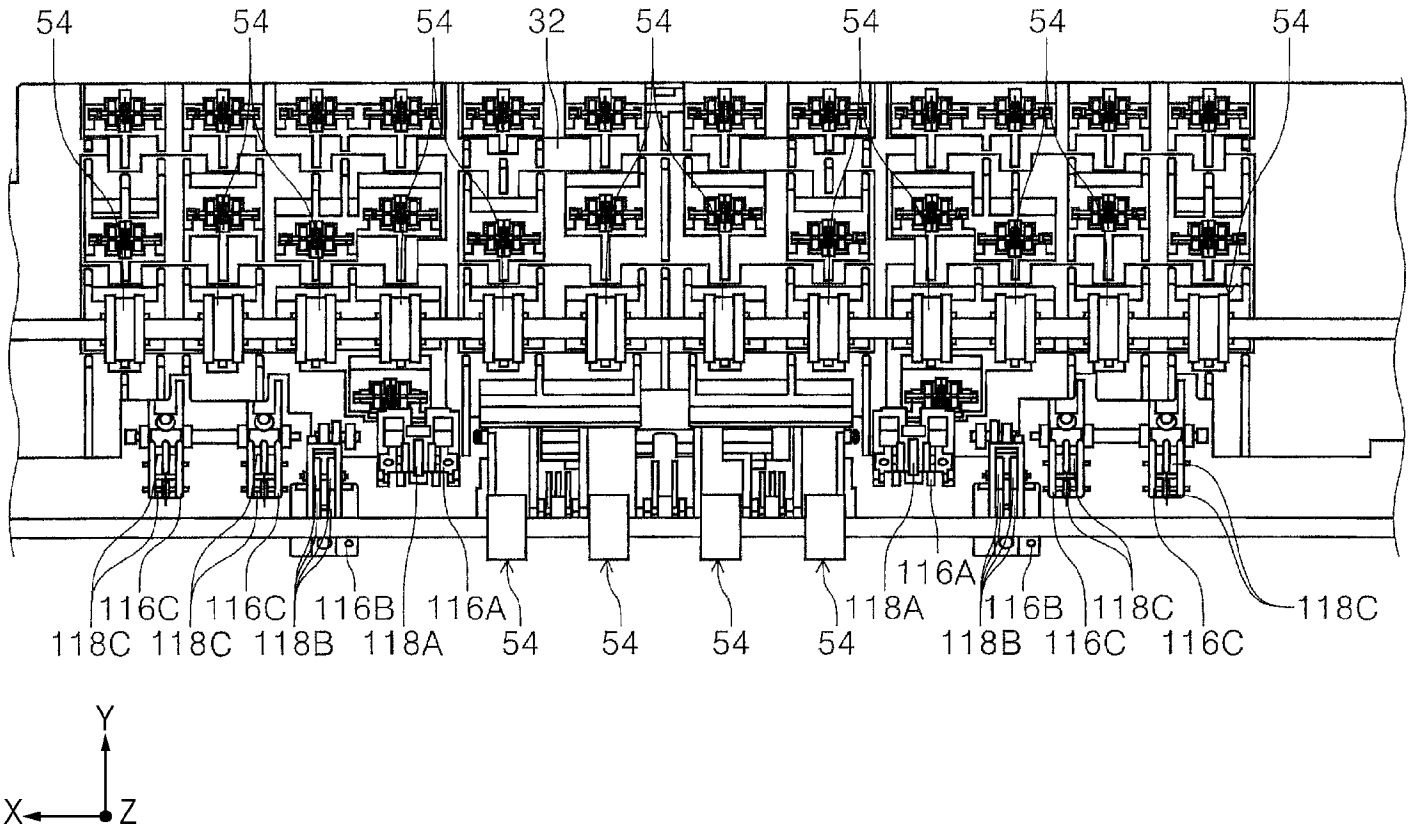
FIG. 9 is a plan view of the neighborhood of the ejection opening of the printer.
Figure 10:
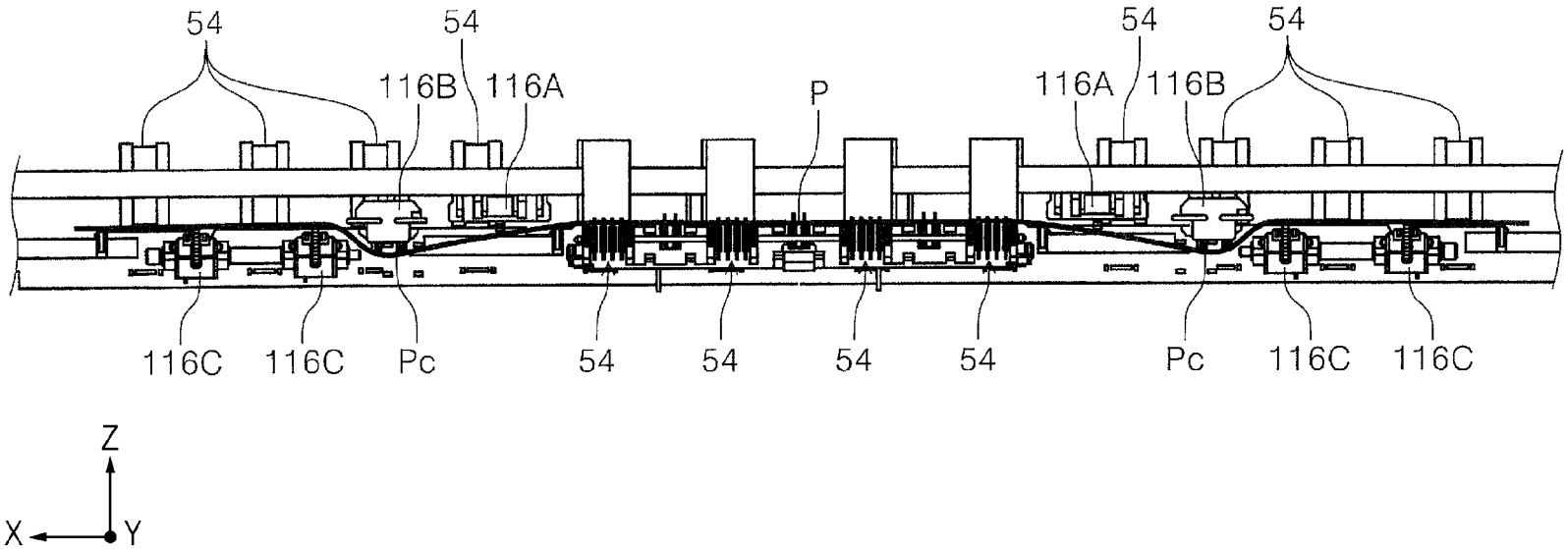
FIG. 10 is a front view of the neighborhood of the ejection opening of the printer.
Figure 11:
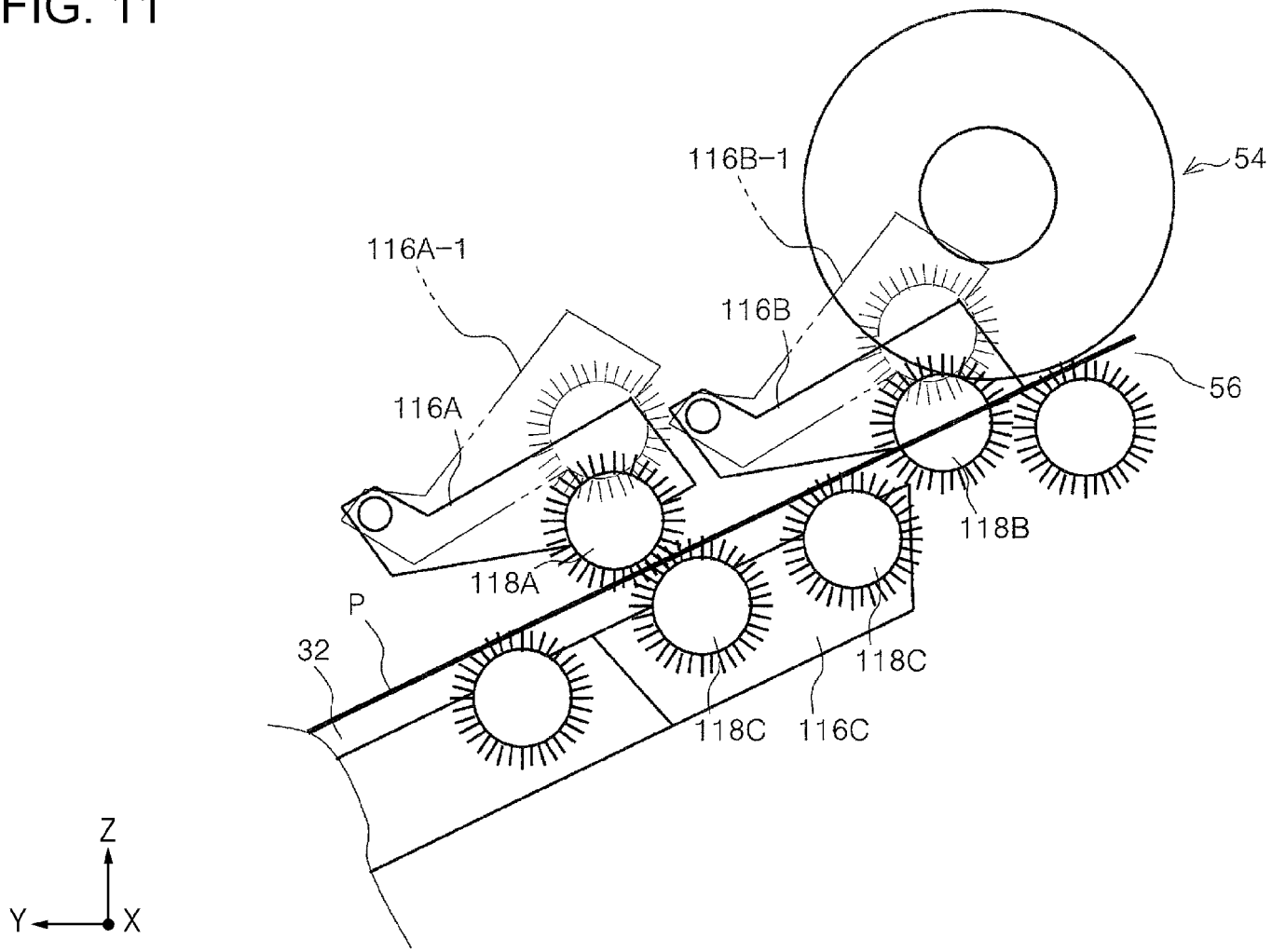
FIG. 11 is a schematic view for explaining switching between a first state and a second state at a contact portion.

FIG. 7 is a side view of a transportation path in a printer that is provided with a relaying portion according to a fifth embodiment. FIG. 8 is a side cross-sectional view of the neighborhood of an ejection opening of a printer according to exemplary embodiments of the disclosure. FIG. 9 is a plan view of the neighborhood of the ejection opening of the printer. FIG. 10 is a front view of the neighborhood of the ejection opening of the printer. FIG. 11 is a schematic view for explaining switching between a first state and a second state at a contact portion.

The X-Y-Z coordinate system shown in each of the accompanying drawings is defined as follows. The X direction represents the direction of the width of a recording target medium, that is, the direction of the depth of a recording apparatus. The Y direction represents the direction in which a recording target medium is transported along a transportation path in the recording apparatus, that is, the apparatus width direction. The Z direction represents the apparatus height direction.

First Embodiment

Overview of Printer

A recording system 10 is illustrated in FIG. 1. The recording system 10 includes, for example, a printer 12, a relaying portion 14, which behaves as an example of a "relaying apparatus", an ejection processing unit 16 (post-processing apparatus), and an external medium supplying unit 18. The printer 12 according to the present embodiment is an ink-jet printer that is an example of a recording apparatus and is configured as a multifunction machine that includes a recording apparatus body 20 as a "housing body" and further includes a scanner unit 22.

In the present embodiment, the recording apparatus body 20 includes, for example, a plurality of medium containers 24. As will be described in detail later, the relaying portion 14 functions as a unit that transports a medium from an ejection opening 56 provided in the recording apparatus body 20 toward the ejection processing unit 16. When a medium that is transported comes in from the relaying portion 14, the ejection processing unit 16 performs predetermined processing on the medium, for example, cutting, sheet folding, punching, stapling, sorting, or the like. In the present embodiment, the medium that is ejected from the ejection opening 56 and is outputted from the ejection processing unit 16 is, for example, in a face-down state, that is, with the (last) recorded side facing down, wherein the last recorded side is, of a sheet of a medium P, the side that faced a line head 38 (described later) last.

The external medium supplying unit 18 is, in the present embodiment, installed under the ejection processing unit 16. A medium contained inside the external medium supplying unit 18 is able to be supplied to the recording apparatus body 20. In FIG. 1, reference numerals are assigned to major components only. In FIGS. 1 to 6, the internal structure of the ejection processing unit 16 is not illustrated. In FIGS. 2 to 6, one only is illustrated as an example of the medium containers 24 provided in the recording apparatus body 20, and the external medium supplying unit 18 is not illustrated.

Next, with reference to FIG. 2, the structure of the relaying portion 14 according to the first embodiment will be explained after an overview of a medium transportation path 26 provided in the recording apparatus body 20. First, the medium transportation path 26 will now be explained. In FIG. 2, reference numerals are assigned to major components only of the transportation path for transporting the medium P. Reference numerals are omitted for other components, in particular, a plurality of spurs.

The medium transportation path 26 includes a feeding path 28, a straight path 30, a face-down ejection path 32, which is an example of a "curved reversal path", a switch-back path 34, and a reversal path 36. The feeding path 28 is a path leading from the medium container 24 to the straight path 30, over which the line head 38 is provided. The line head 38 is an example of a "recording portion". A feeding roller 40, a pair of separating rollers 42, and a pair of transporting rollers 44 are provided on the feeding path 28 along the direction in which the medium P is transported. These rollers are driven to rotate by a driving source that is not illustrated. The medium P is transported from the medium container 24 toward the straight path 30 due to rotation of these rollers. The broken-line curve P1 in FIG. 2 shows the path of the medium P sent from the medium container 24 toward the line head 38.

In the description below, it is assumed that one of each pair of transporting rollers mentioned in this specification is a drive roller that is driven to rotate by a drive motor that is not illustrated and that the other of the two rollers each is a non-drive roller.

The straight path 30 is a path that extends linearly. Transporting rollers 46 making up a pair, a belt conveyor 48, the line head 38, and a first flap 50 are provided thereat in this order along the transportation direction. In the present embodiment, the line head 38 is configured to perform recording by ejecting ink droplets from a plurality of nozzles provided in the head surface of the line head 38 onto the recording target face of the medium P when the medium P is transported by the belt conveyor 48 to the area facing the head surface of the line head 38. The line head 38 according to the present embodiment is, for example, a recording head that has an array of ink-ejecting nozzles arranged to cover the entire area of paper in the width direction and is configured to be able to perform recording on the entire area thereof in the width direction without any movement in the width direction.

After recording by the line head 38, the medium P is transported toward the first flap 50 by the belt conveyor 48. The first flap 50 is controlled by a controller 52 and switches the transportation direction of the medium P to the face-down ejection path 32 or the switchback path 34.

In the present embodiment, for example, the controller 52 is provided inside the recording apparatus body 20. The controller 52 controls the operation of the feeding roller 40, the pair of separating rollers 42, the pairs of transporting rollers 44, 46, 58 (described later), and 64 (described later), pairs of ejecting rollers 54 (described later), the belt conveyor 48, the first flap 50, a second flap 62 (described later), and the line head 38. In addition, the controller 52 controls, for example, the relaying portion 14, the ejection processing unit 16, and the external medium supplying unit 18 (FIG. 1).

The face-down ejection path 32 is a curved reversal path along which, after recording by the line head 38, the medium P moves to be ejected. The medium P that has been guided onto the face-down ejection path 32 by the first flap 50 is transported by the pairs of ejecting rollers 54, which are provided at intervals on the face-down ejection path 32, to the ejection opening 56, which is an example of a "medium ejection opening", and is ejected thereat. Since the face-down ejection path 32 is curved, the medium P moves along the curve to be ejected from the ejection opening 56, with the recorded side (i.e., side recorded by the line head 38) facing down.

The switchback path 34 is a curved path for switching the medium P back after recording by the line head 38. The medium P that has been guided onto the switchback path 34 by the first flap 50 is transported by the pair of transporting rollers 58 provided on the switchback path 34, and the leading edge of the medium P is sent to a curved portion 60, which is provided as the end portion of the switchback path 34.

The second flap 62 is provided over the first flap 50. Linked with the operation of the first flap 50, the second flap 62 operates when driven by a link mechanism that is not illustrated. In a state in which the straight path 30 is connected to the switchback path 34 by the first flap 50 (FIG. 2), the second flap 62 is at a position for disconnection between the switchback path 34 and the reversal path 36. In a state in which the straight path 30 is connected to the face-down ejection path 32 by the first flap 50, the second flap 62 is at a position for connection between the switchback path 34 and the reversal path 36. The reversal path 36 is a path for turning over the medium P that has been switched back by the switchback path 34 and for sending it back to the area facing the line head 38.

After the second flap 62 is positioned for connection between the switchback path 34 and the reversal path 36, the pair of transporting rollers 58 rotates in the reverse direction. Due to the reverse rotation, the trailing edge of the medium P in the switchback path 34 turns into the leading edge, and the medium P is sent onto the reversal path 36. The medium P that has been sent onto the reversal path 36 is transported by the pairs of transporting rollers 64, which are provided at intervals on the reversal path 36, toward the straight path 30. During the process of transportation of the medium P along the reversal path 36, the first side (sheet face on which recording has already been performed by the line head 38) and the second side are reversed with each other, meaning that the sheet of the medium P is turned over. Then, the medium P is transported to, on the straight path 30, the area facing the line head 38, and recording on the second side is performed thereat. After that, for example, the medium P is transported along the face-down ejection path 32 and is ejected from the ejection opening 56.

In FIG. 2, a medium receiving tray 66 is provided over the line head 38 and the reversal path 36. The medium receiving tray 66 is, for example, located inside the area of the recording apparatus body 20 in the Y direction, specifically, at a position where it overlaps with the recording apparatus body 20 as viewed in the Z direction. The relaying portion 14 is located over the medium receiving tray 66 in the Z direction, specifically, between the medium receiving tray 66 and the scanner unit 22 in the Z direction. Moreover, the relaying portion 14 is located downstream of the ejection opening 56 in the direction in which the medium P is transported.

The relaying portion 14 includes a course switcher 68, a transportation path 70, pairs of transporting rollers 71, and a fan 72. The course switcher 68 of the relaying portion 14 is provided near the ejection opening 56 and is able to switch between a position for guiding the medium P ejected from the ejection opening 56 into the transportation path 70 of the relaying portion 14 (this position is illustrated as a solid-line position in FIG. 2) and a position for guiding the medium P ejected from the ejection opening 56 onto the medium receiving tray 66 (this position is illustrated as a broken-line position and denoted as 68-1). The course switcher 68 has a shape of, for example, a flap. The course switcher 68 changes its position in accordance with switching control by the controller 52.

The transportation path 70 extends, for example, from the course switcher 68 in the minus Y direction and is connected to the ejection processing unit 16. Pairs of transporting rollers 71 are provided at predetermined intervals on the transportation path 70. In the present embodiment, for example, one of each pair of transporting rollers 71 is configured to operate by receiving motive power from a non-illustrated driving source that is provided inside the relaying portion 14 or a non-illustrated driving source that is provided inside the recording apparatus body 20. In the present embodiment, in addition to the pairs of transporting rollers 71, spurs are provided at predetermined intervals on the transportation path 70. The structure of the pair of transporting rollers 71 and the plurality of spurs is the same as the structure of those on the following transportation paths described later in other embodiments: a transportation path 80 (FIG. 3), a transportation path 92 (FIG. 4), a transportation path 96 (FIGS. 5 and 6), and a first ejection path 112 and a second ejection path 114 (FIG. 7).

The fan 72 is located downstream of the ejection opening 56 in the transportation direction. The fan 72 is able to blow air toward the medium P ejected from the ejection opening 56. The fan 72 includes, for example, an air-blowing port 72*a* and another air-blowing port 72*b*, and is able to switch the direction in which air is blown. In a case where air is blown from the air-blowing port 72*a* of the fan 72, the medium P that has been ejected from the ejection opening 56 is exposed to the air coming from above in the Z direction. In a case where air is blown from the air-blowing port 72*b* of the fan 72, the air flows along the transportation path 70, and the medium P that moves along the transportation path 70 is exposed to the air. In the present embodiment, in order to show an example, it is explained that the fan 72 performs switching between the air-blowing port 72*a* and the air-blowing port 72*b*. However, the fan 72 may be a rotary fan that is able to change its blowing direction rotationally.

In FIG. 2, in a case where the course switcher 68 is at the solid-line position in FIG. 2 when the medium P is ejected from the ejection opening 56, the ejected medium P is guided into the transportation path 70 by the course switcher 68. The medium P that has been guided into the transportation path 70 is transported by the pairs of transporting rollers 71 along the transportation path 70 toward the ejection processing unit 16. The dot-dot-dash-line arrow P-1 in FIG. 2 shows the path of the medium P transported from the ejection opening 56 along the transportation path 70 to the ejection processing unit 16.

In this case, the air-blowing direction of the fan 72 has been switched toward the transportation path 70. Therefore, the movement of the medium P ejected from the ejection opening 56 toward the transportation path 70 is not obstructed, meaning that the medium P is able to be sent into the transportation path 70 smoothly. Moreover, since air is sent by the fan 72 to the medium P moving along the transportation path 70, the drying of the medium P moving along the transportation path 70 is accelerated.

In a case where the course switcher 68 is at the broken-line position 68-1 in FIG. 2 when the medium P is ejected from the ejection opening 56, the entrance to the transportation path 70 is closed by the course switcher 68, and the ejected medium P is guided toward the medium receiving tray 66. In this case, the fan 72 has been switched into a state of blowing air downward in the apparatus height direction. The medium P that has been ejected from the ejection opening 56 is exposed to the air blown by the fan 72 and coming from above in the Z direction. Drying by the air prevents, or reduces, the curling of the leading edge portion or the trailing edge portion, in the transportation direction, of the medium P that has been ejected from the ejection opening 56, or the side edge portions of the medium P in the width direction. Therefore, the medium P on the medium receiving tray 66 will be in a distortion-free or distortion-reduced state.

Second Embodiment

With reference to FIG. 3, a second embodiment will now be explained. The second embodiment is different from the first embodiment in that a course switcher 74 is provided upstream of the ejection opening 56 in the direction in which the medium P is transported. The structure of the medium transportation path 26 in a recording apparatus body 82 is the same as that of the first embodiment. Therefore, it is not explained here.

In the present embodiment, a recording apparatus body 82 includes a course switcher 74 and a connection path 78. A pair of ejecting rollers 54 is provided on the connection path 78. A relaying portion 76 includes a transportation path 80, pairs of transporting rollers 71, and a fan 72. The course switcher 74 is provided upstream of the ejection opening 56 of the face-down ejection path 32 in the recording apparatus body 82. The course switcher 74 according to the present embodiment is also a flap, which is an example. One end of the connection path 78 is connected to the face-down ejection path 32 at a position upstream of the ejection opening 56 of the face-down ejection path 32. The other end of the connection path 78 is connected to the transportation path 80 of the relaying portion 76. The −Y directional end (minus Y) of the transportation path 80 is connected to the ejection processing unit 16.

In FIG. 3, the course switcher 74 is at a position of directing the medium P on the face-down ejection path 32 toward the ejection processing unit 16 through the connection path 78 and the transportation path 80. When the course switcher 74 is at this position, the medium P coming along the face-down ejection path 32 is not ejected from the ejection opening 56; specifically, the medium P is transported along the connection path 78 by the pair of ejecting rollers 54 to the relaying portion 76, and next along the transportation path 80 of the relaying portion 76 by the pairs of transporting rollers 71 to the ejection processing unit 16. The course switcher 74 also changes its position in accordance with switching control by the controller 52. The dot-dot-dash-line arrow P-2 in FIG. 3 shows the path of the medium P transported along the connection path 78 and next along the transportation path 80 to the ejection processing unit 16.

Though not illustrated, the switching of the flap position of the course switcher 74 closes the entrance to the connection path 78 at the junction where the face-down ejection path 32 is connected to the connection path 78. As a result of the closing of the entrance, the medium P coming along the face-down ejection path 32 is sent toward the ejection opening 56 and is then ejected via the ejection opening 56 toward the medium receiving tray 66.

Variation Example of Second Embodiment

Although the fan 72 is configured to blow air to the medium P ejected from the ejection opening 56, the air from the fan 72 may be directed into the transportation path 80. Such a modified structure helps the medium P dry faster because the medium P moving along the transportation path 70 is exposed to the air coming from the fan 72.

Third Embodiment

With reference to FIG. 4, a third embodiment will now be explained. The third embodiment is different from the first embodiment in that a relaying portion is connected to the ejection opening 56 and that, after the guiding of the medium P ejected from the ejection opening 56 into the relaying portion, it is determined by a course switcher whether to send the medium P toward the ejection processing unit 16 or toward the medium receiving tray 66. The structure of the medium transportation path 26 in the recording apparatus body 20 is the same as that of the first embodiment. Therefore, it is not explained here.

In FIG. 4, a relaying portion 84 includes a reception opening 86, a course switcher 88, a medium ejection opening 90, a transportation path 92, pairs of transporting rollers 71, and a fan 72. The relaying portion 84 is mounted in the recording apparatus body 20 in such a way that the reception opening 86 is connected to the ejection opening 56. In the relaying portion 84, the course switcher 88 is provided at a position where the medium ejection opening 90 is located.

The medium P ejected from the ejection opening 56 moves via the reception opening 86 into the relaying portion 84 and is then sent to the position of the course switcher 88. In a case where the course switcher 88 is at the solid-line position in FIG. 4, the medium ejection opening 90 is in a closed state. Therefore, the medium P is guided into the transportation path 92 by the course switcher 88 and is then transported by the pairs of transporting rollers 71 along the transportation path 92 toward the ejection processing unit 16. The dot-dot-dash-line arrow P-3 in FIG. 4 shows the path of the medium P transported in the relaying portion 84 from the reception opening 86 along the transportation path 92 to the ejection processing unit 16.

In a case where the course switcher 88 is at the broken-line position 88-1 in FIG. 4, the medium ejection opening 90 is in an open state. Therefore, the medium P is guided by the course switcher 88 to be ejected via the medium ejection opening 90 toward the medium receiving tray 66. In the present embodiment, similarly to the foregoing embodiments, the fan 72 is configured to blow air toward the transportation path 92 in a case where the medium P moves along the transportation path 92, and to blow air toward the medium ejection opening 90 in a case where the medium P moves via the medium ejection opening 90. In the present embodiment, similarly to the foregoing embodiments, the course switcher 88 changes its position in accordance with switching control by the controller 52.

Fourth Embodiment

With reference to FIG. 5, a fourth embodiment will now be explained. The fourth embodiment is different from the first embodiment in that a relaying portion is connected to the ejection opening 56 and that, after the guiding of the medium P ejected from the ejection opening 56 into the relaying portion, it is determined by another course switcher whether to send the medium P toward the ejection processing unit 16 or toward the medium receiving tray 66. The structure of the medium transportation path 26 and the neighborhood of the ejection opening 56 in a recording apparatus body 20 is the same as that of the first embodiment. Therefore, it is not explained here.

In FIGS. 5 and 6, a relaying portion 94 includes, in addition to the course switcher 68, a transportation path 96, a first ejection opening 98, a second ejection opening 100, a course switcher 102, which is an example of an "ejection direction switcher", a guide member 104, pairs of transporting rollers 71, and a fan 72. In the relaying portion 94, the +Y directional end of the transportation path 96 is connected to the ejection opening 56. The first ejection opening 98 is provided at the −Y directional end of the transportation path 96. The first ejection opening 98 is connected to the ejection processing unit 16.

The transportation path 96 has the second ejection opening 100 upstream of the first ejection opening 98. The course switcher 102 and the guide member 104 are provided at the position of the second ejection opening 100. The course switcher 102 is a flap and is controlled by the controller 52. The guide member 104 is located below the second ejection opening 100.

In a case where, as illustrated in FIG. 5, the course switcher 102 is at the position of closing the second ejection opening 100 when the medium P that is being transported along the transportation path 96 by the pair of transporting rollers 71 arrives at the position corresponding to the second ejection opening 100, the medium P continues to be transported along the transportation path 96 by the pairs of transporting rollers 71 to the ejection processing unit 16 via the first ejection opening 98. The dot-dot-dash-line arrow P-4 in FIG. 5 shows the path of the medium P transported in the relaying portion 94 along the transportation path 96 to the ejection processing unit 16 via the first ejection opening 98.

In a case where, as illustrated in FIG. 6, the course switcher 102 is at the position of closing the transportation path 96 and opening the second ejection opening 100 when the medium P that is being transported along the transportation path 96 by the pair of transporting rollers 71 arrives at the position corresponding to the second ejection opening 100, the medium P is guided into the second ejection opening 100 by the course switcher 102. The medium P ejected via the second ejection opening 100 is turned over as a result of moving along the curved guide surface 104*a* of the guide member 104, and is ejected onto the medium receiving tray 66 from the downstream side toward the upstream side. Sheets of the medium P ejected in this way are stacked on the medium receiving tray 66 in a face-up state, that is, with the (last) recorded side (the side that faced the line head 38 last) facing up.

In the present embodiment, in a case where the medium P has been sent onto the medium receiving tray 66 by the course switcher 68 from the ejection opening 56, the medium P on the medium receiving tray 66 is in a face-down state, meaning that sheets are stacked with the (last) recorded side (the side that faced the line head 38 last) facing down. In a case where the medium P has been sent onto the medium receiving tray 66 by the course switcher 102 by way of the guide member 104, the medium P on the medium receiving tray 66 is in a face-up state, meaning that sheets are stacked with the (last) recorded side (the side that faced the line head 38 last) facing up. By controlling the course switchers 68 and 102, the controller 52 is able to switch the stack state of the medium P on the medium receiving tray 66 between the face-down state and the face-up state as desired.

In FIGS. 5 and 6, the fan 72 is configured to blow air toward the transportation path 96. The dot-dot-dash-line arrow P-5 in FIG. 6 shows the path of the medium P transported from the transportation path 96 onto the medium receiving tray 66 via the second ejection opening 100 and the guide member 104.

The structure of the fourth embodiment may be applied to the second embodiment, specifically as follows. The second ejection opening 100 may be provided on the transportation path 80 at a −Y directional position with respect to the medium receiving tray 66, and the medium P may be sent toward the medium receiving tray 66 by the course switcher 102 by way of the guide member 104. With this structure, the medium P having been sent onto the medium receiving tray 66 is stacked on the medium receiving tray 66 in a face-up state, that is, with the (last) recorded side (the side that faced the line head 38 last) facing up.

Similarly, the structure of the fourth embodiment may be applied to the third embodiment. Specifically, the second ejection opening 100 may be provided on the transportation path 92, and the medium P may be sent toward the medium receiving tray 66 by the course switcher 102 by way of the guide member 104. With this structure, it is possible to stack the medium P on the medium receiving tray 66 in a face-up state, also for the relaying portion 84.

Fifth Embodiment

With reference to FIG. 7, a fifth embodiment will now be explained. The fifth embodiment is different from the first embodiment in that a plurality of ejection paths is provided in the transportation path.

A relaying portion 106 includes a course switcher 108, an ejection path switcher 110, a first ejection path 112, a second ejection path 114, pairs of transporting rollers 71, and a fan 72. The course switcher 108 of the relaying portion 106 is provided near the ejection opening 56 and is able to switch between a position for guiding the medium P ejected from the ejection opening 56 into the relaying portion 106 (this position is illustrated as a solid-line position in FIG. 7) and a position for guiding the medium P ejected from the ejection opening 56 onto the medium receiving tray 66 (this position is illustrated as a broken-line position and denoted as 108-1). The course switcher 108 has a shape of, for example, a flap. The course switcher 108 changes its position in accordance with switching control by the controller 52.

In the relaying portion 106, the ejection path switcher 110 is provided downstream of the course switcher 108. The ejection path switcher 110 has a shape of, for example, a flap. In accordance with control by the controller 52, the ejection path switcher 110 is able to switch between a position for guiding the medium P into the first ejection path 112 (this position is illustrated as a solid-line position in FIG. 7) and a position for guiding the medium P into the second ejection path 114 (this position is illustrated as a broken-line position and denoted as 110-1 in FIG. 7).

The first ejection path 112 and the second ejection path 114 are connected to the ejection processing unit 16 at the downstream side in the direction in which the medium P is transported. The medium P is sent to the ejection processing unit 16, regardless of which path is taken. In the present embodiment, similarly to the foregoing embodiments, the fan 72 is configured to blow air toward the first ejection path 112 and the second ejection path 114 in a case where the medium P moves along the first ejection path 112 or the second ejection path 114, and to blow air toward the medium P from above in the Z direction in a case where the medium P moves toward the medium receiving tray 66. The dot-dot-dash-line arrow P-6 in FIG. 7 shows, in the relaying portion 106, the path of the medium P transported through the first ejection path 112 to the ejection processing unit 16. The broken-line arrow P-7 in FIG. 7 shows, in the relaying portion 106, the path of the medium P transported through the second ejection path 114 to the ejection processing unit 16.

Variation Examples of Embodiments (1) The relaying portion 14 (FIG. 2), 76 (FIG. 3), 84 (FIG. 4), 94 (FIGS. 5 and 6), 106 (FIG. 7) may be detachably attached to the recording apparatus body 20, 82. For example, the relaying portion may be able to be detached or drawn out in the +X direction (frontward in the apparatus depth direction). With such a structure, the attachment and detachment of the relaying portion 14 (FIG. 2), 76 (FIG. 3), 84 (FIG. 4), 94 (FIGS. 5 and 6), 106 (FIG. 7) is easy even in a case where the ejection processing unit 16 is installed adjacently at the −Y directional side, wherein the Y direction is the horizontal direction. Because of easy attachment and detachment, work efficiency in maintenance or replacement of the relaying portion 14 (FIG. 2), 76 (FIG. 3), 84 (FIG. 4), 94 (FIGS. 5 and 6), 106 (FIG. 7) improves.

(2) A part of the relaying portion 14 (FIG. 2), 76 (FIG. 3), 84 (FIG. 4), 94 (FIGS. 5 and 6), 106 (FIG. 7), for example, the transportation path 70 (FIG. 2), 80 (FIG. 3), 92 (FIG. 4), 96 (FIGS. 5 and 6), the first ejection path 112 (FIG. 7) and the second ejection path 114 (FIG. 7), may be open at the +X directional side or at the −Z directional side.

(3) Although a single fan 72 is provided in the foregoing embodiments, in the relaying portion 14 (FIG. 2), 76 (FIG. 3), 84 (FIG. 4), 94 (FIGS. 5 and 6), 106 (FIG. 7), a fan that corresponds to the transportation path 70 (FIG. 2), 80 (FIG. 3), 92 (FIG. 4), 96 (FIGS. 5 and 6), the first ejection path 112 (FIG. 7) and the second ejection path 114 (FIG. 7) and a fan that corresponds to the path toward the medium receiving tray 66 may be provided separately from each other.

(4) Although the external medium supplying unit 18 is provided under the ejection processing unit 16 in the foregoing embodiments, as a modified structure, the external medium supplying unit 18 under the ejection processing unit 16 may be omitted. Since a space is formed under the ejection processing unit 16 in such a structure, in a case where there is a jammed sheet of the medium P transported from a lower medium container 24 among the medium containers 24 provided in the recording apparatus body 20, 82, a user is able to open a cover provided at the position corresponding to the space on the recording apparatus body 20, 82 and remove the jammed sheet of the medium P from the transportation path easily.

(5) The ejection processing unit 16 may be coupled to the printer 12 via a rotary shaft extending in the Z direction. A side portion at the −Y directional side of the printer 12 becomes exposed as a result of user's rotating the ejection processing unit 16 around the rotary shaft away from the printer 12. The transportation path of the medium P transported from the medium container 24 becomes accessible as a result of user's opening a cover provided in the side portion. Because of such a structure, sheet-jam troubleshooting is easy.

Structure of Contact Portion

Next, with reference to FIGS. 7 to 10, a contact portion 116 will now be explained. A contact portion 116 is provided upstream of the ejection opening 56 of the face-down ejection path 32 in the recording apparatus body 20, 82. As illustrated in FIG. 8, the contact portion 116 includes first, second, and third contact portions 116A, 116B, and 116C. Spurs (serrated rollers) 118A, 118B, and 118C are rotatably mounted on the first, second, and third contact portions 116A, 116B, and 116C respectively. Plural segments that make up, among the pairs of ejecting rollers 54, the pair of ejecting rollers 54 that is the closest to the ejection opening 56 in FIG. 8 are provided at proper intervals in the center region in the X direction.

In FIG. 8, as viewed in the direction in which the medium P is transported, a pair of first contact portions 116A is located upstream of, among the pairs of ejecting rollers 54, the pair of ejecting rollers 54 that is the closest to the ejection opening 56. In addition, the pair of first contact portions 116A is located outside the plural segments making up the pair of ejecting rollers 54 in the X direction. In FIG. 7, the first contact portions 116A are located over the face-down ejection path 32. The spurs 118A of the first contact portions 116A protrude into the face-down ejection path 32.

In FIG. 8, as viewed in the direction in which the medium P is transported, at least spurs 118B of a pair of second contact portions 116B are located upstream of, among the pairs of ejecting rollers 54, the pair of ejecting rollers 54 that is the closest to the ejection opening 56. In addition, the pair of second contact portions 116B is located outside the pair of first contact portions 116A in the X direction. The spurs 118B are located downstream of the spurs 118A as viewed in the direction in which the medium P is transported. In FIG. 7, the second contact portions 116B are located over the face-down ejection path 32. The spurs 118B of the second contact portions 116B protrude into the face-down ejection path 32. The amount of protrusion of the spurs 118B of the second contact portions 116B into the face-down ejection path 32 is larger than the amount of protrusion of the spurs 118A of the first contact portions 116A into the face-down ejection path 32.

In FIG. 8, as viewed in the direction in which the medium P is transported, at least spurs 118C of two pairs of third contact portions 116C are located upstream of, among the pairs of ejecting rollers 54, the pair of ejecting rollers 54 that is the closest to the ejection opening 56. In addition, the two pairs of third contact portions 116C are located outside the pair of second contact portions 116B in the X direction. The spurs 118C are located between the spurs 118A and the spurs 118B as viewed in the direction in which the medium P is transported. In FIG. 7, the third contact portions 116C are located under the face-down ejection path 32. The spurs 118C of the third contact portions 116C protrude into the face-down ejection path 32.

In FIG. 9, when the medium P transported along the face-down ejection path 32 comes to the ejection opening 56, the medium P comes into contact with the spurs 118A of the first contact portions 116A, the spurs 118B of the second contact portions 116B, and the spurs 118C of the third contact portions 116C, all of which are located upstream of the pair of ejecting rollers 54 that is the closest to the ejection opening 56. The spurs 118A of the first contact portions 116A and the spurs 118B of the second contact portions 116B are configured to be in contact with the medium P from above and push the medium P downward. The spurs 118C of the third contact portions 116C are configured to be in contact with the medium P from below and push the medium P upward.

In a state in which the medium P is nipped by the pair of ejecting rollers 54 that is the closest to the ejection opening 56, at both sides as viewed in the direction of the width of the medium P (X direction), curved portions Pc, which are not flat with respect to the center portion nipped by the pair of ejecting rollers 54 that is the closest to the ejection opening 56, are produced by the first, second, and third contact portions 116A, 116B, and 116C as illustrated in FIG. 10. The curves enhance the stiffness of the medium P before the medium P is ejected from the ejection opening 56 onto the medium receiving tray 66. Because of the enhanced stiffness, it is possible to prevent, or reduce, the curling of the leading edge portion or the trailing edge portion, in the transportation direction, of the medium P, or the side edge portions of the medium P in the width direction. The bold curve denoted as P in FIG. 10 shows a state of deformation of the medium P in the width direction.

Next, with reference to FIG. 11, switching of the contact portion will now be explained. For example, the first contact portions 116A and the second contact portions 116B are switchable between a first state and a second state, wherein the first state is a state of protrusion of the spurs 118A and 118B into the face-down ejection path 32 for contact with the medium P ejected toward the medium receiving tray 66, and wherein the second state is a state of retraction of the spurs 118A and 118B from the face-down ejection path 32 for non-contact with the medium P in a case where the medium P is directed into the relaying portion 14, 84, 94, 106 by the course switcher 68, 88, 102, 108. The solid-line illustration in FIG. 11 depicts the first state of the first contact portions 116A and the second contact portions 116B. The dot-dot-dash-line illustration, denoted as 116A-1 and 116B-1, in FIG. 11 depicts the second state of the first contact portions 116A and the second contact portions 116B.

Since the first contact portions 116A and the second contact portions 116B are put into the second state when the medium P moves from the ejection opening 56 into the relaying portion 14, 84, 94, 106, no curved portion Pc is produced in the medium P. Therefore, it is possible to prevent jamming of the medium P due to failure to make its way into the entrance of the relaying portion 14 (FIG. 2), 84 (FIG. 4), 94 (FIGS. 5 and 6), 106 (FIG. 7) or the course switcher 68 (FIG. 2), 88 (FIG. 4), 102 (FIG. 5), 108 (FIG. 7) conformingly when the medium P, which would have increased stiffness otherwise due to production of the curved portions Pc, enters the relaying portion.

Although it is assumed in the present embodiment that the third contact portions 116C are fixed, the third contact portions 116C may be switchable between the first state and the second state, similarly to the first contact portions 116A and the second contact portions 116B.

The above description can be summarized as follows. The printer 12 includes: the recording apparatus body 20, 82 in which the line head 38 that performs recording on the medium P is housed; the face-down ejection path 32 along a curve of which the medium P, after the recording by the line head 38, is turned over to be guided to a position above the line head 38; the medium receiving tray 66 that is provided over the line head 38 at a position of horizontally overlapping with the recording apparatus body 20, 82, that is, overlapping in the Y direction, and receives the medium P ejected through the face-down ejection path 32; the relaying portion 14 (FIG. 2), 76 (FIG. 3), 84 (FIG. 4), 94 (FIGS. 5 and 6), 106 (FIG. 7) that is provided over the medium receiving tray 66 at a position of overlapping with the recording apparatus body 20, 82 and sends the medium P coming along the face-down ejection path 32 to an area horizontally outside the recording apparatus body 20, 82, that is, outside in the Y direction; and the course switcher 68 (FIG. 2), 74 (FIG. 3), 88 (FIG. 4), 102 (FIGS. 5 and 6), 108 (FIG. 7) that switches a course of the medium P beyond the face-down ejection path 32 from one to the other, and from the other to one, of the medium receiving tray 66 and the relaying portion 14, 76, 84, 94, 106.

In the above structure, the relaying portion 14, 76, 84, 94, 106, which sends the medium P coming along the face-down ejection path 32 to an area horizontally outside the recording apparatus body 20, 82, that is, outside in the Y direction, is provided over the medium receiving tray 66 at a position of overlapping with the recording apparatus body 20, 82. Therefore, it is possible to reduce the Y-directional area occupancy, that is, the horizontal area occupancy, of the relaying portion 14, 76, 84, 94, 106 configured to send the medium P toward, for example, the ejection processing unit 16, which is an example of a post-processing apparatus installed at the area outside the recording apparatus body 20, 82, or it is possible to avoid the relaying portion 14, 76, 84, 94, 106 alone from occupying any Y-directional horizontal area. In other words, the recording system 10 that is compact as a whole is realized by providing the relaying portion 14, 76, 84, 94, 106 in a space-saving manner.

The relaying portion 14 is located downstream of the ejection opening 56 beyond the face-down ejection path 32; and the course switcher 68 is provided in the relaying portion 14 and performs switching whether to cause the medium P to move into the relaying portion 14 or to cause the medium P to move toward the medium receiving tray 66. Since the relaying portion 14 is located downstream of the ejection opening 56 beyond the face-down ejection path 32, this structure makes it possible to eject the medium P from the ejection opening 56 even if the relaying portion 14 has been detached.

The course switcher 74 (FIG. 3) is provided upstream of the ejection opening 56 beyond the face-down ejection path 32, and performs switching whether to cause the medium P exiting from the face-down ejection path 32 to move into the relaying portion 76 not via the ejection opening 56 or to cause the medium P exiting from the face-down ejection path 32 to move toward the medium receiving tray 66 via the ejection opening 56. This structure ensures that the connection path 78 and the transportation path 80, that is, the medium transportation path in the relaying portion 76, are relatively long. Therefore, this structure increases the time from the execution of recording on the medium P to the ejection of the medium P, thereby allowing sufficient time for ejected ink on the recorded surface of the medium P to dry.

The relaying portion (FIG. 4) includes the course switcher 88; the reception opening 86 for receiving the medium P coming along the face-down ejection path 32; and the medium ejection opening 90 via which the medium P is ejected toward the medium receiving tray 66; and the course switcher 88 performs switching whether to cause the medium P received via the reception opening 86 to move toward the area outside the recording apparatus body 20 or to cause the medium P received via the reception opening 86 to move toward the medium receiving tray 66 via the medium ejection opening 90.

With this structure, it is possible to provide the course switcher 88 while achieving ease of work by assembling the relaying portion 84 including the course switcher 88. Moreover, by modularizing the relaying portion 84 including the course switcher 88 as a unit, it is possible to make the attachment and detachment of the recording apparatus body 20 easy; accordingly, it is possible to easily and speedily switch from a state in which the printer 12 is used alone to a state in which the printer 12 is used as a component of the recording system 10, or from a state in which the printer 12 is used as a component of the recording system 10 to a state in which the printer 12 is used alone.

The recording apparatus further includes: the contact portion 116 (FIGS. 8 to 11) that is provided upstream of the ejection opening 56 and produces, in the medium P, a curved portion Pc that is curved in a medium width direction by contact with at least a part of the medium P in the medium width direction, which is a direction intersecting with a medium transportation direction; and the contact portion 116 is switchable between a first state, which is a state of contact with the medium P in a case where the course switcher 68 (FIG. 2), 88 (FIG. 4), 102 (FIGS. 5 and 6), 108 (FIG. 7) causes the medium P to move toward the medium receiving tray 66, and a second state, which is a state of non-contact with the medium P in a case where the course switcher 68, 88, 102, 108 causes the medium P to move into the relaying portion 14, 84, 94, 106.

With this structure, since the contact portion 116 is put into the first state in a case where the course switcher 68, 88, 102, 108 causes the medium P to move toward the medium receiving tray 66, it is possible to prevent the curling of the medium P ejected onto the medium receiving tray 66, especially in the direction of medium ejection. Specifically, the curved portion Pc is produced in the medium P due to the contact of the contact portion 116 with the medium P in the first state. By this means, it is possible to enhance the stiffness of the medium P. Because of the enhanced stiffness, it is possible to prevent, or reduce, the curling of the leading edge portion or the trailing edge portion, in the transportation direction, of the medium P, or the side edge portions of the medium P in the width direction. Since the contact portion 116 is put into the second state in a case where the course switcher 68, 88, 102, 108 causes the medium P to move into the relaying portion 14, 84, 94, 106, no curved portion Pc is produced in the medium P. Therefore, entry at the reception opening 86, at which the medium P is received into the relaying portion 14, 84, 94, 106, is smooth.

The recording apparatus further includes: the fan 72 that blows air toward the medium P ejected from the ejection opening 56; the fan 72 directs the air toward the medium receiving tray 66 when in a state in which the course of the medium P has been switched toward the medium receiving tray 66 by the course switcher 68 (FIG. 2), 88 (FIG. 4), 108 (FIG. 7), and directs the air into the direction of movement of the medium P when in a state in which the course of the medium P has been switched toward the relaying portion 14, 84, 106 by the course switcher 68, 88, 108.

With this structure, since the recording apparatus further includes the fan 72 that blows air toward the medium P ejected from the ejection opening 56, and since the fan 72 directs the air toward the medium receiving tray 66 when in a state in which the course of the medium P has been switched toward the medium receiving tray 66 by the course switcher 68, 88, 108, it is possible to let the medium P fall onto the medium receiving tray 66 properly. Moreover, since the fan 72 directs the air into the direction of movement of the medium P when in a state in which the course of the medium P has been switched toward the relaying portion 14, 84, 106 by the course switcher 68, 88, 108, it is possible to cause the medium P to move into the reception opening 86, at which the medium P is received into the relaying portion 14, 84, 94, 106, properly.

The relaying portion 94 (FIG. 6) includes the first ejection opening 98 for ejection of the received medium P to the area outside the recording apparatus body 20; the second ejection opening 100 for ejection of the received medium P from a downstream side toward an upstream side of the medium receiving tray 66; and the course switcher 102 that switches the course of the medium P from one to the other, and from the other to one, of the first ejection opening 98 and the second ejection opening 100. Since the relaying portion 94 includes the second ejection opening 100 as another ejection opening for ejection of the received medium P in addition to the first ejection opening 98, the degree of freedom in ejection of the medium P increases.

The relaying portion 94 includes the guide member 104 that guides the medium P ejected from the second ejection opening 100 onto the medium receiving tray 66 while turning over the medium P. With this structure, it is possible to switch which side of the medium P is to be oriented toward the medium receiving tray 66 (switching between "face up" and "face down), thereby meeting diverse needs of users.

The relaying portion 106 (FIG. 7) includes the first ejection path 112 and the second ejection path 114 through which the received medium P is able to be ejected to the area outside the recording apparatus body 20; and the ejection path switcher 110 that performs switching for selecting either one, the first ejection path 112 or the second ejection path 114, for the received medium P. With this structure, it is possible to accept a larger amount of the medium P into the relaying portion 106, and, especially in a case where ink is ejected by the line head 38 onto the medium P, it is possible to allow longer time for the ink to dry inside the relaying portion 106.

The relaying portion 14 (FIG. 2), 76 (FIG. 3), 84 (FIG. 4), 94 (FIGS. 5 and 6), 106 (FIG. 7) ejects the medium P to the ejection processing unit 16 that is an example of a post-processing apparatus that is installed adjacent to the printer 12. With this structure, in a case where the ejection processing unit 16, as an example of a post-processing apparatus, is installed adjacent to the printer 12, it is possible to reduce the Y-directional area occupancy, that is, the horizontal area occupancy, of the relaying portion 14, 76, 84, 94, 106, or it is possible to avoid the relaying portion 14, 76, 84, 94, 106 alone from occupying any Y-directional horizontal area, thereby realizing the recording system 10 that is compact as a whole.

A relaying apparatus is provided over the medium receiving tray 66 of the printer 12. The printer 12 includes the recording apparatus body 20, 82, the face-down ejection path 32, and the medium receiving tray 66. The line head 38 that performs recording on the medium P is housed in the recording apparatus body 20, 82. Along a curve of the face-down ejection path 32, after the recording by line head 38, the medium P is turned over to be guided to a position above the line head 38. The medium receiving tray 66 is provided over the line head 38 at a position of horizontally overlapping with the recording apparatus body 20, 82 and receives the medium P ejected through the face-down ejection path 32. As the relaying apparatus mentioned above, the relaying portion 14 (FIG. 2), 76 (FIG. 3), 84 (FIG. 4), 94 (FIGS. 5 and 6), 106 (FIG. 7) is configured to send the medium P coming along the face-down ejection path 32 to an area horizontally outside the recording apparatus body 20, 82, and includes the course switcher 68 (FIG. 2), 74 (FIG. 3), 88 (FIG. 4), 102 (FIGS. 5 and 6), 108 (FIG. 7) that switches a course of the medium P beyond the face-down ejection path 32 from one to the other, and from the other to one, of the medium receiving tray 66 and an inside of the relaying portion 14, 76, 84, 94, 106.

In the exemplary embodiments, the relaying portion 14, 76, 84, 94, 106 according to the present disclosure is applied to an ink-jet printer that is an example of a recording apparatus. However, the relaying portion may be applied to other various kinds of a liquid ejecting apparatus.

The term "liquid ejecting apparatus" includes, but not limited to, a recording apparatus such as a printer, a copier, and a facsimile, etc. that includes an ink-jet recording head and performs recording by ejecting ink onto a recording target medium from the head. It further encompasses a variety of apparatuses that ejects, in place of ink, liquid used in its specific application from a liquid ejecting head corresponding to an ink-jet recording head onto a liquid ejection target medium corresponding to a recording target medium so as to put the liquid onto the medium.

Examples of a liquid ejecting head are: a recording head mentioned above, a color material ejection head used in the production of a color filter for a liquid crystal display, etc.; an electrode material (i.e., conductive paste) ejection head used for the electrode formation of an organic EL display device, a surface/plane emission display (FED), etc.; a living organic material ejection head used for production of biochips; and a sample ejection head that functions as a high precision pipette.

The scope of the disclosure is not limited to the foregoing embodiments. It may be modified, altered, changed, adapted, and/or improved within the scope of the recitation of appended claims. Needless to say, such a modification, etc. is also within the scope of the disclosure.

What is claimed is:

1. A recording apparatus, comprising:

a housing body in which a recording portion that performs recording on a medium is housed;

a curved reversal path along a curve of which the medium, after the recording by the recording portion, is turned over to be guided to a position above the recording portion;

a medium receiving tray that is provided over the recording portion at a position of horizontally overlapping with the housing body and receives the medium ejected through the curved reversal path;

a relaying portion that is provided over the medium receiving tray at a position of horizontally overlapping with the housing body and sends the medium coming along the curved reversal path to a post-processing apparatus that is installed adjacent to the recording apparatus;

a course switcher that switches a course of the medium beyond the curved reversal path from one to the other, and from the other to one, of the medium receiving tray and the relaying portion, wherein the curved reversal path and the course switcher are housed in the housing body; and a scanner unit that scans a document, wherein the relaying portion includes a pair of transporting rollers that send the medium to the post-processing apparatus, wherein the relaying portion is located between the medium receiving tray and the scanner unit in a recording apparatus height direction, wherein the relaying portion is located downstream of a medium ejection opening beyond the curved reversal path, wherein the course switcher is provided in the relaying portion and performs switching whether to cause the medium to move into the relaying portion or to cause the medium to move toward the medium receiving tray, a contact portion is provided upstream of the medium ejection opening and produces, in the medium, a curved portion that is curved in a medium width direction by contact with at least a part of the medium in the medium width direction, which is a direction intersecting with a medium transportation direction, wherein the contact portion is switchable between a first state, which is a state of contact with the medium in a case where the course switcher causes the medium to move toward the medium receiving tray, and a second state, which is a state of non-contact with the medium in a case where the course switcher causes the medium to move into the relaying portion.

2. The recording apparatus according to claim 1, wherein the course switcher is provided upstream of a medium ejection opening beyond the curved reversal path, and performs switching whether to cause the medium exiting from the curved reversal path to move into the relaying portion not via the medium ejection opening or to cause the medium exiting from the curved reversal path to move toward the medium receiving tray via the medium ejection opening.

3. The recording apparatus according to claim 1, wherein the relaying portion includes the course switcher;

a reception opening for receiving the medium coming along the curved reversal path; and a medium ejection opening via which the medium is ejected toward the medium receiving tray; and wherein the course switcher performs switching whether to cause the medium received via the reception opening to move toward the area outside the housing body or to cause the medium received via the reception opening to move toward the medium receiving tray via the medium ejection opening.

4. The recording apparatus according to claim 1, further comprising:

a fan that blows air toward the medium ejected from the medium ejection opening;

wherein the fan directs the air toward the medium receiving tray when in a state in which the course of the medium has been switched toward the medium receiving tray by the course switcher, and directs the air into a medium movement direction when in a state in which the course of the medium has been switched toward the relaying portion by the course switcher.

5. The recording apparatus according to claim 1, wherein the relaying portion includes a first ejection opening for ejection of the received medium to the area outside the housing body;

a second ejection opening for ejection of the received medium from a downstream side toward an upstream side of the medium receiving tray; and an ejection direction switcher that switches the course of the medium from one to the other, and from the other to one, of the first ejection opening and the second ejection opening.

6. The recording apparatus according to claim 5, wherein the relaying portion includes a guide member that guides the medium ejected from the second ejection opening onto the medium receiving tray while turning over the medium.

7. The recording apparatus according to claim 1, wherein the relaying portion includes a plurality of ejection paths through which the received medium is able to be ejected to the area outside the housing body; and an ejection path switcher that performs switching for selecting one of the plurality of ejection paths for the received medium.

8. The recording apparatus according to claim 1, wherein the medium receiving tray receives the medium whereon printing is completed.

9. A relaying apparatus that is provided over a medium receiving tray of a recording apparatus that includes a housing body in which a recording portion that performs recording on a medium is housed, includes a curved reversal path along a curve of which the medium, after the recording by the recording portion, is turned over to be guided to a position above the recording portion, a scanner unit that scans a document, and further includes the medium receiving tray, which is provided over the recording portion at a position of horizontally overlapping with the housing body and receives the medium ejected through the curved reversal path, the relaying apparatus being configured to send the medium coming along the curved reversal path to a post-processing apparatus that is installed adjacent to the recording apparatus such that the medium is no longer in the housing body, the relaying apparatus comprising:

a course switcher that switches a course of the medium beyond the curved reversal path from one to the other, and from the other to one, of the medium receiving tray and an inside of the relaying apparatus, wherein the curved reversal path and the course switcher are housed in the housing body, wherein the relaying portion is located between the medium receiving tray and the scanner unit in a recording apparatus height direction, wherein the relaying portion is located downstream of a medium ejection opening beyond the curved reversal path, wherein the relaying portion includes a pair of transporting rollers that send the medium to the post-processing apparatus, wherein the course switcher is provided in the relaying portion and performs switching whether to cause the medium to move into the relaying portion or to cause the medium to move toward the medium receiving tray, a contact portion is provided upstream of the medium ejection opening and produces, in the medium, a curved portion that is curved in a medium width direction by contact with at least a part of the medium in the medium width direction, which is a direction intersecting with a medium transportation direction, wherein the contact portion is switchable between a first state, which is a state of contact with the medium in a case where the course switcher causes the medium to move toward the medium receiving tray, and a second state, which is a state of non-contact with the medium in a case where the course switcher causes the medium to move into the relaying portion.

10. The recording apparatus according to claim 1, wherein the pair of transporting rollers send the medium to an area horizontally outside the housing body.

11. The recording apparatus according to claim 9, wherein the pair of transporting rollers send the medium to an area horizontally outside the housing body.

12. A recording apparatus that sends a medium to a post-processing apparatus that is connected to, but is separate from the recoding apparatus, comprising:

a housing body in which a recording portion that performs recording on the medium is housed; a curved reversal path along a curve of which the medium, after the recording by the recording portion, is turned over to be guided to a position above the recording portion;

a medium receiving tray that is provided over the recording portion at a position of horizontally overlapping with the housing body and receives the medium ejected through the curved reversal path;

a scanner unit that can scan a document;

a relaying portion that is provided between the medium receiving tray and the scanner unit in a recording apparatus height direction and sends the medium coming along the curved reversal path to the post-processing apparatus that is installed adjacent to the recording apparatus such that the medium is no longer in the housing body; and a course switcher that switches a course of the medium beyond the curved reversal path from one to the other, and from the other to one, of the medium receiving tray and the relaying portion, wherein the curved reversal path, the relaying portion and the course switcher are housed in the housing body, wherein the relaying portion is located downstream of a medium ejection opening beyond the curved reversal path, wherein the course switcher is provided in the relaying portion and performs switching whether to cause the medium to move into the relaying portion or to cause the medium to move toward the medium receiving tray, a contact portion is provided upstream of the medium ejection opening and produces, in the medium, a curved portion that is curved in a medium width direction by contact with at least a part of the medium in the medium width direction, which is a direction intersecting with a medium transportation direction, wherein the contact portion is switchable between a first state, which is a state of contact with the medium in a case where the course switcher causes the medium to move toward the medium receiving tray, and a second state, which is a state of non-contact with the medium in a case where the course switcher causes the medium to move into the relaying portion.

13. A recording apparatus, comprising:

a housing body in which a recording portion that performs recording on a medium is housed;

a curved reversal path along a curve of which the medium, after the recording by the recording portion, is turned over to be guided to a position above the recording portion;

a medium receiving tray that is provided over the recording portion at a position of horizontally overlapping with the housing body and receives the medium ejected through a medium ejection opening of the curved reversal path;

a relaying portion that is provided over the medium receiving tray at a position of horizontally overlapping with the housing body and sends the medium coming along the curved reversal path to an area outside the housing body; and a course switcher that switches a course of the medium beyond the curved reversal path from one to the other, and from the other to one, of the medium receiving tray and the relaying portion, wherein the curved reversal path, the relaying portion and the course switcher are housed in the housing body, performs switching that causes the medium to move into the relaying portion or causes the medium to move toward the medium receiving tray, the course switcher connecting the relaying portion and the curved reversal path across the medium ejection opening when causing the medium to move into the relaying portion, wherein the curved reversal path, the relaying portion and the course switcher are housed in the housing body, wherein the relaying portion sends the medium to a post-processing apparatus that is installed adjacent to the recording apparatus, wherein the relaying portion is located downstream of a medium ejection opening beyond the curved reversal path, wherein the relaying portion includes a pair of transporting rollers that send the medium to the post-processing apparatus, wherein the relaying portion is located between the medium receiving tray and the scanner unit in a recording apparatus height direction, wherein the course switcher is provided in the relaying portion and performs switching whether to cause the medium to move into the relaying portion or to cause the medium to move toward the medium receiving tray, a contact portion is provided upstream of the medium ejection opening and produces, in the medium, a curved portion that is curved in a medium width direction by contact with at least a part of the medium in the medium width direction, which is a direction intersecting with a medium transportation direction, wherein the contact portion is switchable between a first state, which is a state of contact with the medium in a case where the course switcher causes the medium to move toward the medium receiving tray, and a second state, which is a state of non-contact with the medium in a case where the course switcher causes the medium to move into the relaying portion.

* * * * *